US006860918B2

(12) United States Patent
Ozaki et al.

(10) Patent No.: US 6,860,918 B2
(45) Date of Patent: Mar. 1, 2005

(54) POWDER ADDITIVE FOR POWDER METALLURGY, IRON-BASED POWDER MIXTURE FOR POWDER METALLURGY, AND METHOD FOR MANUFACTURING THE SAME

(75) Inventors: Yukiko Ozaki, Chiba (JP); Shigeru Unami, Chiba (JP); Satoshi Uenosono, Chiba (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/442,429

(22) Filed: May 21, 2003

(65) Prior Publication Data

US 2004/0038067 A1 Feb. 26, 2004

(30) Foreign Application Priority Data

May 21, 2002 (JP) ..... 2002-145991
Dec. 4, 2002 (JP) ..... 2002-352325

(51) Int. Cl.[7] ..... B22F 1/02
(52) U.S. Cl. ..... 75/252; 428/407; 428/570
(58) Field of Search ..... 75/252, 255; 428/407, 428/570

(56) References Cited

U.S. PATENT DOCUMENTS 5,135,566 A * 8/1992 Sakuranda et al. ..... 75/255
5,279,640 A * 1/1994 Ogura et al. ..... 75/343
5,472,661 A * 12/1995 Gay ..... 419/36
5,538,684 A * 7/1996 Luk et al. ..... 419/66
6,139,600 A * 10/2000 Ozaki et al. ..... 75/255
6,280,683 B1 * 8/2001 Hendrickson et al. ..... 419/37
6,296,682 B1 * 10/2001 Uenosono et al. ..... 75/254

* cited by examiner

*Primary Examiner*—Ngoclan T. Mai
(74) *Attorney, Agent, or Firm*—Piper Rudnick LLP

(57) ABSTRACT

The surface of the body of powder additive for use in powder metallurgy is coated with an organic binder, thereby obtaining powder additive to cause adhesion of the powder additive to the surface of iron-based powder by the organic binder, thereby providing a powder additive with no segregation of components and excellent flowability and compression, and an iron-based powder mixture manufactured by mixing the powder additive and the iron-based powder.

26 Claims, 3 Drawing Sheets

POWDER ADDITIVE FOR POWDER METALLURGY, IRON-BASED POWDER MIXTURE FOR POWDER METALLURGY, AND METHOD FOR MANUFACTURING THE SAME

BACKGROUND

1. Field of the Invention

This invention relates to a powder additive for powder metallurgy, to be mixed in an iron-based powder which is a primary raw material powder to obtain a powder mixture for powder metallurgy, such as alloying powder or machinability improving powder or the like. Also, this invention relates to a method for manufacturing the powder additive for powder metallurgy. Further, this invention relates to an iron-based powder mixture for powder metallurgy wherein the powder additives for powder metallurgy are bonded to the surface of iron powder by an organic binder, and a method of producing thereof.

2. Description of the Related Art

An iron-based powder mixture for powder metallurgy generally is an iron-based powder of iron powder or alloy steel powder or the like, to which powder additives for powder metallurgy and a lubricant are added as needed. Examples of the powder additives for powder metallurgy added include alloying powders such as copper powder, graphite powder, iron phosphide or the like, machinability improving powders such as MnS powder, BN powder, CaF powder or the like. Examples of lubricants include zinc stearate, aluminum stearate, lead stearate and the like.

In recent years, there have been increasing demands for reduction in costs of sintered materials and, thus, reduction in manufacturing costs. For example, preventing segregation of raw material powders such as the iron-based powder, powder additives, and lubricant, reduces dimensional irregularity at the time of compact sintering. Consequently, the costs necessary for correcting the dimensions of the sintered material following sintering by the cutting process can be reduced. Accordingly, various endeavors have been made to prevent segregation of the iron-based powder mixture for powder metallurgy.

Further, there have also been demands for reduction in manufacturing costs of the iron-based powder mixture for powder metallurgy itself.

Using an organic binder to bond powder additives to the iron-based powder is known to be effective in preventing segregation of the iron-based powder mixture for powder metallurgy. The following are well-known techniques:

(1) Wet mixing: Powder additives, the iron-based powder, and the lubricant are mixed with a liquid wherein an organic binder has been dispersed or dissolved, from which the dispersion medium or solvent is dried (e.g., Japanese Patent No. 2,582,231 (Claims), Japanese Examined Patent Application Publication No. 5-27682 (Claims)).

(2) Dry mixing: The powder additives, the iron-based powder, and a solid organic binder are heated while mixing, and the organic binder is melted and then cooled to bind the powder additives for powder metallurgy and the iron-based powder together. A particularly preferred technique is to mix in a solid lubricant, and to heat and melt at least part of the solid lubricant to serve as an organic binder (e.g., Japanese Unexamined Patent Application Publication No. 2-57602 (Claims), Japanese Unexamined Patent Application Publication No. 3-162502 (Claims)).

FIG. 2 is a model diagram of the iron-based powder mixture for powder metallurgy obtained by the above-described wet mixing method and dry mixing method. Normally, powder additive 7 is formed of a powder additive particle proper 1, which binds to the surface of iron-based powder 3 by the additionally-mixed organic binder 2.

However, with either method, increasing the amount of organic binder added to sufficiently prevent segregation inevitably leads to an increase in useless binder 4 which does not contribute to binding of the iron-based powder and the powder additives, but simply adheres to the surface of the powder additive or the iron-based powder, causing problems such as a decrease in green density because useless binder occupies volume that inhibits the iron base powder. Also, there is an increase in useless binder floating free, which does not adhere to the raw material powders. Accordingly, the above methods do not sufficiently improve segregation of iron-based powder mixture for powder metallurgy.

OBJECTS OF THE INVENTION

Accordingly, it is an object of the invention to solve the above problems and provide an iron-based powder mixture for powder metallurgy wherein segregation has been decreased without decrease in green density of the mixture powder, and a low-cost and effective manufacturing method thereof.

It is another object of the invention to provide a powder additive for powder metallurgy, for obtaining such an iron-based powder mixture, and an effective manufacturing method thereof.

SUMMARY OF THE INVENTION

According to a first aspect of the invention, the following powder additives are provided: (1) A Powder additive for powder metallurgy comprising: bodies of the powder additive particles; and organic binder provided to the surface thereof. It is preferable that said bodies of the particles are coated with said organic binder. It is also preferable that the organic binder is dispersed substantially all over the surface of the bodies of the particles.

(2) The powder additive for powder metallurgy according to (1) wherein the powder is an alloying powder or a machinability improving powder.

(3) The powder additive for powder metallurgy according to (1) or (2) wherein the organic binder may be at least one type selected from thermoplastic resins and waxes.

According to a second aspect of the invention, the following method is provided: (4) a method for manufacturing powder additive for powder metallurgy, wherein a processing liquid, prepared by dissolving an organic binder in a solvent or dispersing an organic binder in a dispersion medium is mixed with bodies of powder additive particles and, subsequently, the solvent or dispersion medium in the processing liquid is dried to provide the organic binder to the surface of the bodies of powder additive particles. It is preferable to use water as the dispersion medium.

According to a third aspect of the invention, the following iron-based powder mixtures are provided: (5) an iron-based powder mixture for powder metallurgy comprising the powder additive for powder metallurgy according to any of the above (1) to (3), bonded to the surface of iron-based powder by the organic binder.

(6) The iron-based powder mixture for powder metallurgy according to (5) wherein the surface of the iron-based powder to which the powder additive has been bonded is wholly covered with a lubricant. It is preferable that the covering lubricant comprises lubricant particles.

(7) The iron-based powder for powder metallurgy according to (6) wherein the lubricant comprising particles with an average particle size of about 0.01 to about 10 μm.

(8) The iron-based powder mixture for powder metallurgy according to any one of (5) to (7) wherein the iron-based powder mixture further comprises a free lubricant.

(9) The iron-based powder mixture for powder metallurgy according to (8) wherein the free lubricant used in the iron-based powder mixture for powder metallurgy includes secondary particles aggregated by agglomerating primary particles. The primary particles of the free lubricant are preferably about 0.01 to about 80 μm. It is also preferable that the free lubricant contains at least about 20% by volume of secondary particles with an particle size of about 10 to about 200 μm as to the total value of the free lubricant.

(10) The iron-based powder mixture for powder metallurgy according to (8) or (9) wherein the free lubricant is added in a range of about 0.01 to about 2.0 parts by weight to 100 parts by weight of the total amount of the primary raw material powder and the bodies of powder additives particles. It is preferable that the iron-based powder to which the powder additives has been bonded is wholly covered with the lubricant as (6), and that the average particle size of the primary particles of the free lubricant are about 0.01 to about 80 μm, with the free lubricant containing at least about 20% by volume of secondary particles with a particle size of about 10 to about 200 μm as to the total amount of the free lubricant. (11) The iron-based powder mixture for powder metallurgy comprising an iron-based powder which is a primary raw material powder, and the powder additives according to any one of the above (1) to (3), wherein the iron-based powder and the powder additives are bonded by the organic binder which is provided onto the body of the powder additive particles, and wherein substantially no organic binder is provided on the surface of said iron-based powder except for the portion of said bonding.

According to a fourth aspect of the invention, the following methods are provided:

(12) a method for manufacturing an iron-based powder mixture for powder metallurgy, wherein iron-based powder and the powder additives for powder metallurgy according to any one of (1) to (3) are mixed while heating to a point or higher where at least one component of the organic binder reaches the melting point or softening point thereof, so that at least a part of the organic binder is melted, following which the mixture is cooled so that the powder additive is bonded to the surface of the iron-based powder by the organic binder.

(13) The method according to (12) wherein the mixture is formed by the powder additive being bonded to the surface of the iron-based powder by the organic binder, followed by the mixture being heated to a temperature lower than the melting point of the organic binder while coating a processing liquid prepared by dissolving a lubricant in a solvent or dispersing a lubricant in a dispersion medium on the mixture to substantially cover the surface of the iron-based powder with the processing liquid, followed by the dispersion medium or the solvent being vaporized by a drying process to substantially cover the iron-based powder with the lubricant. For the method to coat the processing liquid, it is preferable to spray the processing liquid on the powder. It is also preferable that the iron-based powder is wholly coated by the lubricant.

(14) The method according to (13) wherein the lubricant comprises particles with an average particle size of about 0.01 to about 10 μm.

(15) The method according to any one of (12) to (14) wherein after the powder additive for powder metallurgy is bonded to the surface of the iron-based powder by the organic binder, a free lubricant is added, and then mixed.

(16) The method according to (15) wherein the free lubricant includes secondary particles aggregated by agglomerating primary particles. The average particle size of the primary particles of the free lubricant are preferably about 0.01 to about 80 μm. It is also preferable that the free lubricant contains at least about 20% by volume of secondary particles with a particle size of about 10 to about 200 μm as to the total amount of the free lubricant. At the time of adding the free lubricant and then mixing, mixing is preferably performed with a shearing force which does not crush the secondary particles. In the method according to (16), it is especially preferable to satisfy every preferred condition above.

(17) The method according to (15) or (16) wherein the free lubricant is added in a range of about 0.01 to about 2.0 parts by weight to 100 parts by weight of the total amount of the primary raw material powder and the body of powder additive particles.

The invention configured and carried out thus improves the quality of the finished product while facilitating manufacturing and lowering costs at the same time. Further features and advantages of the present invention will become more apparent from the detailed description.

DETAILED DESCRIPTION

We first studied an ideal bonding state between differing particles within an iron-based powder mixture for powder metallurgy, i.e., the powder additives for powder metallurgy and the iron-based powder. We reached the conclusion that while an ideal state is that binder exists only between the different particles to be bonded and that no binder exists at surface portions of the particles unrelated to the mutual adhesion thereof, selectively creating a presence of binder only at this portion is extremely difficult. Thus, we studied various examples close to this state.

As a result, we discovered that, for example, to broadly cover the surface of the powder additive (the body of the powder particles, or the particles proper), which has a relatively small number of particles, with binder beforehand, and then later mixing that powder with the iron-based powder which is the primary raw material, yields excellent results.

That is to say, the powder additives have a relatively small number of particles and, accordingly, the particles are surrounded by the iron-based powder which is the primary raw material (a so-called "clathrate state"), so that the powder additives come into contact with and is bound to the iron-based powder with a high probability. Accordingly, binder inevitably comes to exist between the adjacent powder-metallurgical powder additive particles, contributing to mutual adhesion. Moreover, a suitable inter-particle binding state wherein there is no presence of unnecessary binder on the portion of iron-based powder not adjacent to a different type of particle, can be realized.

On the other hand, in the event of covering the iron-based powder particles with binder, the probability that the iron-based particles come into contact one with another is high, so the efficiency of the binder does not improve very much.

Further, we have discovered that using thermoplastic resins or waxes as an organic binder, and heating to or above the softening or melting point of the thermoplastic resins or the waxes at the time of mixing with the iron-based powder to bind, causes the thermoplastic resins or waxes to melt and penetrate between the different particles to form liquid bridging, thereby forming a powerful point of binding.

We confirmed that component segregation is markedly alleviated in an iron-based powder mixture for powder metallurgy obtained by an powder additive covered with organic binder beforehand being mixed with iron-based powder, heated to the softening or melting point of the organic binder, and subsequently cooled.

Figure 1:
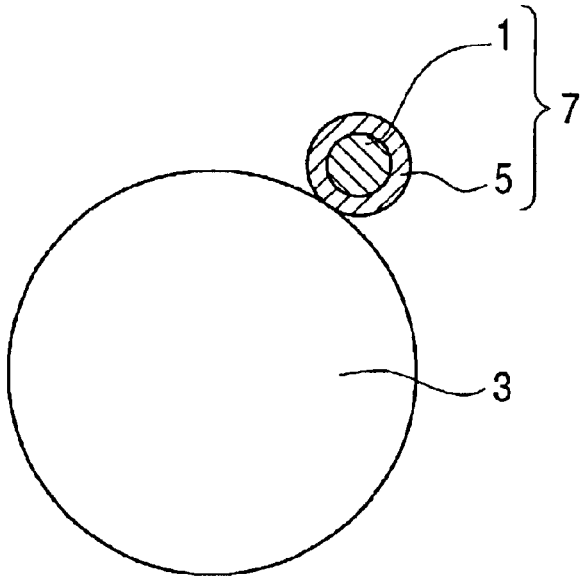
FIG. 1 is a model diagram illustrating a powder additive for powder metallurgy according to aspects of the invention, and an iron-based powder mixture for powder metallurgy according to aspects of the invention.
Figure 2:
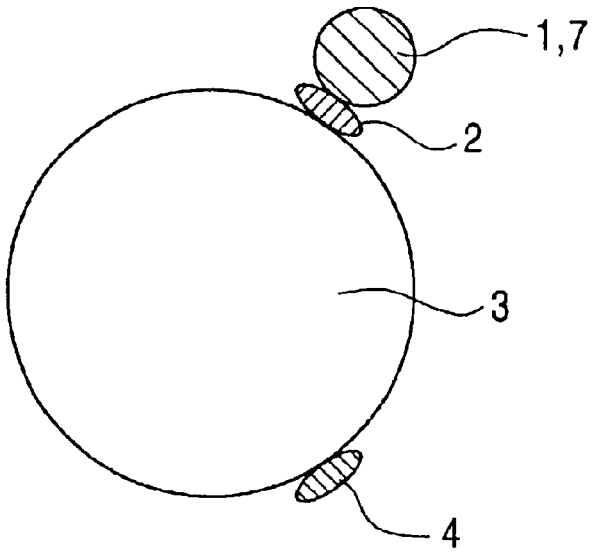
FIG. 2 PRIOR ART
FIG. 2 is a model diagram illustrating a conventional iron-based powder mixture for powder metallurgy.

FIG. 1 is a model diagram illustrating a powder additive for powder metallurgy according to aspects of the invention adhering to an iron-based powder for powder metallurgy.

In the invention, a powder-metallurgy powder additive particle proper 1, namely, the body of a powder additive particle, is substantially covered with an organic binder 5 beforehand, collectively forming a powder-metallurgy powder additive 7. The powder-metallurgy powder additive 7 is bound to the surface of an iron-based powder 3 by the organic binder 5.

This invention was completed by further studies based upon the above-described knowledge.

The invention will now be described in further detail. The above-described aspects of the invention will be described in further detail, before describing specific examples. Note that the order of describing the selected aspects will be reversed here, to facilitate such description.

One aspect of the invention relates to the powder additive for powder metallurgy wherein organic binder has been applied to the surface of the particles proper.

Figure 4:
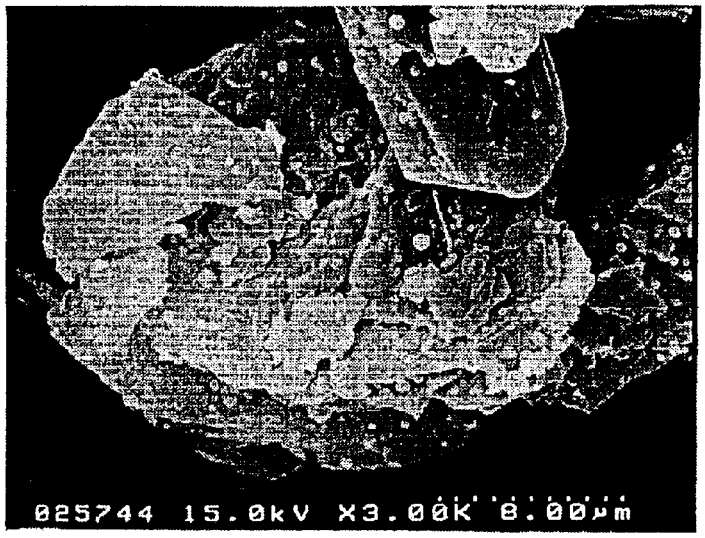
FIG. 4 is an SEM image of another powder additive for powder metallurgy (graphite powder) according to aspects of the invention.
Figure 5:
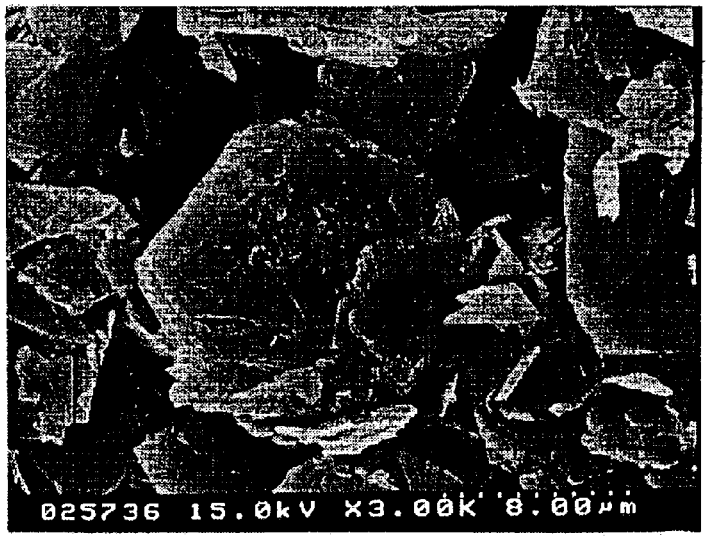
FIG. 5 PRIOR ART
FIG. 5 is an SEM image of powder additive for powder metallurgy (graphite powder) without providing an organic binder to the surface.

As shown in FIG. 1, substantially the entire surface of the powder-metallurgy powder additive particle proper is preferably covered with the organic binder. However, interspersing the organic binder on the entire face of the powder additive particle proper is also effective. FIGS. 4 and 5 are SEM images of graphite powder serving as powder additives particles, wherein FIG. 5 shows an image according to a conventional technique wherein organic binder has not been provided. On the other hand, FIG. 4 shows an image wherein organic binder particles (small particles with a generally-spherical shape) are interspersed on the entire surface of the graphite particles(proper), according to this invention. We confirmed that the advantages of the invention, which are prevention of segregation and maintaining high green density, can be achieved by the form of providing binder as shown in FIG. 4, as well.

While the amount of organic binder to be provided depends on the dimensions and shape of the primary raw material powder and the powder additive particle proper and, accordingly, cannot be categorically stated, 1% coverage (in area) is thought to be sufficient in the event that the binder is an interspersed type and is uniformly distributed to a sufficient degree.

Thus, in one aspect, an organic binder is used for the binder. This is due to the fact that inorganic binder generally has adverse effects on sinterability.

An example of a preferable organic binder is thermoplastic resin. Also, in the event of using thermoplastic resin, the softening or melting point thereof is preferably about 100 to about 160° C. In the event that the softening or melting point is below about 100° C., the viscosity of the melted thermoplastic resin is low and readily flows away from the surface of the powder additive in the heating processing performed for manufacturing the iron-based powder mixture. Accordingly, the functions thereof as a binder are less than optimal. Also, in the event that the softening or melting point exceeds about 160° C., the temperature must be set that much higher in the heating process, inviting oxidation of the surface of the iron-based powder. Oxidation of the iron-based powder deteriorates the mechanic properties of the sintered material following sintering. Therefore, using a binder with a high softening or melting point necessitates measures to be taken to prevent oxidization.

One or two or more of the following are preferably selected and used for the thermoplastic resin: polyester resin, polypropylene resin, polyethylene resin, butyral resin, ethylene vinyl acetrate (EVA) resin, terpene phenyl resin, styrene-butadiene elastomer, styrene acrylate copolymers, acrylic resin, and ester methacrylate copolymer resin.

Further, the above-described polyester resin is preferably a powder, and the surface of the polyester resin powder is preferably covered with a hydrophilic resin layer. Also, the molecular structure of the polyester resin is most preferably a linear-saturation polyester resin or a denatured ether polyester resin.

Also, in one aspect, the organic binder may be a wax. At least one of the following is preferably selected and used for the wax: paraffin wax, micro-crystalline wax, Fischer-Tropsch wax, and polyethylene wax. The suitable range of melting point for the waxes is substantially the same as that for the thermoplastic resins.

Further, the above-mentioned thermoplastic resins and waxes may be used together for the organic binder. Addition of a wax improves the viscosity of the resin at the time of heating and melting. Stable bridging is thereby formed between the surface of the powder additive for powder metallurgy and the surface of the iron-based powder, which improves the adhesive force thereof.

The sum of organic binder to be provided to the powder additive is preferably about 0.5 to about 50 parts by weight as to 100 parts by weight of the powder-metallurgy powder additive particle proper (i.e., 100 parts by weight of the total weight of the body of the powder additive particle). In the event that the amount of organic binder is less than about 0.5 parts by weight, the adhesive force of the organic binder reduces and in the event that the amount of organic binder exceeds about 50 parts by weight, the adhesive force of the powder particles one to another becomes so strong that the flowability of the powder additives and the iron-based powder mixture using it deteriorates. Particularly preferable is a range between about 1 to about 30 parts by weight.

The powder-metallurgy powder additive according to one aspect of the invention is the raw materials of the powder used for powder metallurgy other than the iron-based powder which is the primary component thereof. Prominent examples are alloying powders such as graphite powder, copper powder, Ni-based powder, Mo-based powder, and the like, and/or machinability improving powders such as MnS powder, BN powder, CaF powder, hydroxy apatite powder, and the like. Addition of lubricants does not aim to use the lubricants as ingredients. Therefore, even free lubricants are not counted as powder additivess.

Alloying powders adjust the chemical composition of the powder-metallurgy product and, accordingly, are added to adjust the mechanical properties of the product. Common examples are carbon, metal, or alloy powder. Segregation of these greatly affects the uniformity and dimensional precision of the product, so the advantages reaped by applying the invention are great.

Machinability improving powders are added as a foreign material serving as a break originating point when cutting, and generally are metal inorganic compounds. The adverse effects of segregation thereof are generally considered to be smaller than those of alloying powders.

Advantageously used for graphite powder is one of natural graphite, synthetic graphite, and spherulite, with an average particle size of about 0.1 to about 50 $\mu$m. In the event that the average particle size is smaller than about 0.1 $\mu$m, the graphite powder agglomerates with itself and the organic binder is not readily provided. Also, agglomerated graphite powder is not readily pulverized, thereby increasing the burden on the process. On the other hand, in the event that the average particle size exceeds about 50 $\mu$m, the probability that pin holes will occur on the interior and the surface of the sintered material following compaction of the iron-based powder mixture for powder metallurgy and sintering thereof. Pin holes invite deterioration in strength of the sintered material, and a less desirable external appearance and, accordingly, are undesirable.

Advantageously used for copper powder are atomized copper powder, electrolytic copper powder, oxide-reduced copper powder, cuprous oxide powder, and the like.

Advantageously used for Ni-based powder and Mo-based powder are atomized Ni powder, carbonyl Ni powder, oxide-reduced Ni powder, and atomized Mo powder, carbonyl Mo powder, oxide-reduced Mo powder, respectively.

Powder obtained by mechanically pulverizing and sieving copper ingots may be used for alloying powder such as Ni—Fe, Mo—Fe, and the like.

The average particle size for the alloying powder such as Cu powder, Ni-based powder and Mo-based powder is preferably about 0.1 to about 50 $\mu$m. In the event that the average particle size is smaller than about 0.1 $\mu$m, the same problems as with the graphite powder occur. On the other hand, in the event that the average particle size exceeds about 50 $\mu$m, sintering at high temperatures for long periods of time becomes necessary at the time of sintering following compaction of the iron-based powder mixture for powder metallurgy, to allow the Cu, Ni, and Mo to sufficiently disperse.

Further, with the powder additives for powder metallurgy, machinability improving powders such as MnS powder, BN powder, CaF powder, hydroxy apatite powder and the like, effectively contribute to improvement in the mechanical properties of the sintered material and, accordingly, are added as needed. The most preferable particle size for this powder is also about 0.1 to about 50 $\mu$m.

Another aspect of the invention is a method for manufacturing the powder additives for powder metallurgy according to the above-described aspect. This another aspect will be described now.

A preferable method manufacturing the powder additive for powder metallurgy according to one aspect involves first dissolving thermoplastic resin powder in a solvent, or dispersing the thermoplastic resin powder in a dispersion medium as with an emulsion or other type of dispersion liquid, thereby preparing a processing liquid. This processing liquid is mixed with uncoated powder additive for powder metallurgy (i.e., the powder additive particles proper), following which the solvent or the dispersion medium is dried, and further the substance is pulverized, yielding the powder additive for powder metallurgy according to that aspect. Note that waxes or the like may be further added to and mixed with the processing liquid.

Also, a processing liquid using wax alone may be used. The processing liquid in this case as well is a dispersion liquid or a solution.

Also, the powder additive is a single substance, meaning that organic binder is applied to the surface thereof by the above-described method before mixing with any other primary powders or powder additives.

In the event of using a suitable emulsion as a dispersion liquid, the average particle size of the resin powder dispersed in the emulsion (the primary particle size) is preferably in the range of about 0.01 to about 5 $\mu$m, and preferably is smaller than the particle size of the powder additive proper upon which it is to be coated (or interspersed; hereafter, the term "coat" as used herein may also imply "intersperse" in the same way, as an alternative mode of application with similar effects). In the event that the average particle size is smaller than about 0.01 $\mu$m, drying the solvent in the subsequent process requires extra time, raising the cost of coating with resin. On the other hand, in the event that the average particle size exceeds about 5 $\mu$m, covering substantially the entire surface of the powder additive for powder metallurgy in a uniform manner becomes difficult.

The dispersion medium of the emulsion serving as the processing liquid is preferably water or alcohol, and is selected as suitable according to the powder additive proper which is to be coated.

For example, in the event of a powder such as graphite powder or BN powder which is insoluble in water and relatively difficult to become oxidized, water is preferably used as a dispersion medium, thereby reducing manufacturing costs and enhancing safety of the workplace for the coating process.

Further, a small amount of surface-active agent may be added to improve wettability of the water and powder. A surface-active agent regarding which suitable characteristics are known (or predictable) for the powder additive proper to which it is to be applied is preferably selected. Also, non-ionic surface-active agents, which do not contain active metal ions such as K, Na, and the like, are preferably used. The reason is that in the event that the surface-active agent contains K, Na, or the like, these may remain in the sintered material when being used for the iron-based powder mixture for powder metallurgy, which can invite rusting and deterioration of strength.

Also, with powder which easily oxidizes, such as copper powder, Ni-based powder, Mo-based powder and the like, or powder which is water-soluble or high affinity for water molecules, such as MnS powder, CaF powder, hydroxy apatite powder, and the like, alcohol is preferably used as a dispersion medium.

However, in the event of using alloying powder (copper powder, Ni-based powder, Mo-based powder, and the like), a processing liquid wherein water with a rust inhibitor added thereto is used as the dispersion medium may be applied with no problem. Addition of the rust inhibitor is not restricted to processing liquid for powder which is readily oxidized.

In the event of using alcohol as the dispersion medium, those which have greater molecular mass for organic groups are preferable. Examples include isopropyl alcohol, butyl alcohol, and the like. Alcohols with a small molecular mass such as methyl alcohol exhibit properties like those of water, and also may contain water as an impurity. Hence, the alcohol should be selected upon careful consideration of the properties of the powder (proper) with which it is to be used.

Also, in the event of using a solvent to prepare the processing liquid, the above descriptions apply in the same way.

Further, the above-described powder proper which is readily oxidized and the powder proper with a high affinity to water molecules are preferably coated with a resin emulsion, or used with a solution wherein resin has been dissolved in an organic solvent. There are no particular restrictions on the solvent so long as resin can be dissolved. However, solvents not containing chlorine are preferable from the perspective of preventing environmental contamination.

In the event of mixing a powder additive particles proper without any coating and an emulsion wherein a thermoplastic resin powder has been dispersed or a solution wherein a thermoplastic resin powder has been dissolved, a resin kneader (biaxial rotary kneader), Henschel mixer, V-shaped blender, attritor and the like, may be used for the kneader. The lower the viscosity of the resin emulsion is, the better the mixing is, and preferably is about 1 to about 60% by mass as to the content of the solid component to the emulsion. In the event that the content of the solid component is less than about 1% by mass, the ratio of the solvent is high, requiring time in the subsequent drying process which undesirably raises manufacturing costs. On the other hand, in the event that this exceeds about 60% by mass, the viscosity of the resin emulsion or solution increases, increasing the burden on the facilities for mixing.

Next, the mixture of the powder additive and the resin emulsion or solution is dried, removing the solvent or dispersion medium. The removal of the solvent or dispersion medium may be performed in a rotary kiln, mesh belt furnace, muffle furnace, or the like, or may be subjected to reduced-pressure drying. The temperature for drying is preferably lower than the softening or melting point of the added resin. In the event that drying is performed at the softening or melting point of the resin or higher, the resin softens or melts, and the particles agglomerate, thereby leading to an increased burden in the later-described pulverizing process.

The powder additive covered with resin by drying is mechanically pulverized. Pulverizing may be performed with a pulverizer such as a hammer mill, jaw crusher, jet mill or the like, or powdering may be performed by rotating stirring blades with a Henschel mixer or the like. The powder thus obtained is adjusted to the desired particle size by sieve classification or air classification.

Next, the fourth aspect of the invention will be described. According to this aspect, the following method is preferably used for manufacturing the iron-based powder mixture for powder metallurgy.

The powder additives for powder metallurgy according to the first aspect(one aspect) are mixed with iron-based powder (so-called "primary mixing"), the mixture is heated to the softening or melting point of at least one component of the organic binder or higher, thereby melting part or all of the organic binder (including cofusing), and then cooled. This process binds the powder additives to the iron-based powder.

Following cooling, a lubricant may be added and then mixed as needed (so-called "secondary mixing"). Or, the lubricant may be mixed during the primary mixing. Though lubricants which function as binder may be applied, advantages of the invention are basically exhibited by providing the binder to the powder additives beforehand.

Note that the invention (the first aspect, i.e., providing of the organic binder) does not need to be applied for all powder additives making up the iron-based powder mixture for powder metallurgy. In the event of further mixing in powder additives to which the first aspect has not been applied, the degree of adhesion of the powder additives to which the invention has not been applied as to the primary raw material powder improves. Of course, the invention is preferably applied to all powder additives, from the perspective of improved adhesion.

In the event that the heating temperature in the primary mixing is less than the softening or melting point of at least one type of component of the organic binder, the binder on the surface of the particles does not soften or melt at the time of heating and mixing, so sufficient adhesion cannot be obtained.

In the event that lubricants are added in the primary mixing, the heating temperature in the primary mixing is preferably higher than the melting point of at least one type of added lubricant. In addition to the softening or melting of the organic binder, melting of the lubricant increases the volume of the liquid bridge formed between the iron-based powder and the powder-metallurgical powder additive particles increases, thereby further facilitating mutual adhesion.

In the second mixing, addition of lubricants is preferably performed as follows.

One of the following methods is carried out following binding powder metallurgy powder additives to the surface of iron-based powder by the organic binder, thereby forming a mixed powder.

(1) Coating Method

A processing liquid is prepared by dispersing a lubricant (lubricant particles with a preferably average particle size of about 0.01 to about 10 $\mu$m) in a dispersion medium or dissolving the lubricant in a solvent, the mixed powder is heated to a temperature lower than the melting point of the organic binder and the processing liquid is coated onto the mixed powder by means such as spraying or the like, thus substantially covering the surface of the iron-based powder with the processing liquid. Next, the dispersion medium or solvent is vaporized by a drying processes and the entire surface of the iron-based powder is covered with a lubricant. Note that the term "disperse" is used in a broad sense, including emulsification. Also, the phrase "a temperature lower than the melting point of the organic binder" indicates a temperature lower than the melting point of the component of the organic binder with the lowest melting point thereof.

(2) Aggregation-type Lubricant Mixing Method

A solid free lubricant is added and mixed in following cooling of the mixed powder. Further, the free lubricant is preferably secondary particles. The preferable average particle size of the primary particles is about 0.01 to about 80 $\mu$m, and a free lubricant containing about 20% by volume or more as to the entire free lubricant of secondary particles about 10 to about 200 $\mu$m in particle size, aggregated by agglomeration of the primary particles. Further, the amount of the free lubricant to be added is preferably in the range of about 0.01 to about 2.0 parts per weight as to at total of 100 parts per weight of the primary raw material powder (iron-based powder) and the body of the powder additive particles. Also, at the time of adding the free lubricant and then mixing, mixing should be performed with a shearing force which does not destroy the secondary particles.

(3) Coating Method+Aggregation-type Lubricant Mixing Method

A processing liquid is prepared by dispersing a lubricant (lubricant particles with a preferred average particle size of about 0.01 to about 10 μm) in a dispersion medium or dissolving the lubricant in a solvent, the mixed powder is heated to a temperature lower than the melting point of the organic binder and the processing liquid is coated onto the mixed powder by means such as spraying or the like, thereby substantially covering the surface of the iron-based powder with the processing liquid. Next, the dispersion medium or solvent is vaporized by a drying process and the entire surface of the iron-based powder is covered with lubricant particles, following which the mixed powder is cooled, and a free lubricant (preferably a free lubricant including secondary particles) is added and mixed in. The preferred conditions for the free lubricant and the mixing method thereof are the same as those described above at item (2).

In the above-described coating method ((1), (3)), the reason that the preferred average particle size for the lubricant particles to be used is about 0.01 to about 10 μm is that in the event that the average particle size is smaller than about 0.01 μm, after the surface of the iron-based powder being covered, solvent molecules intrude in between the lubricant particles which increases the burden on the drying process and, on the other hand, in the event that the average particle size exceeds about 10 μm, dispersion or dissolving in the dispersion medium or the solvent becomes difficult, so the covering process for the surface of the iron-based powder becomes difficult. Note that there is no restriction on the shape of the lubricant particles. They may be spherical or flake-shaped, depending on the type of lubricant. Values obtained by laser diffraction/scattering, as described later in the first Example, were used for the particle size.

Also, with conventional powder additives, organic solvents were used as the dispersion medium or solvent for the lubricant from the perspective of preventing oxidation of the iron-based powder and the powder additives. This necessitated a process for rendering the vaporized flammable solvent harmless and so forth. However, with the invention, the dispersion medium or solvent continuously is vaporized by applying the processing liquid wherein the lubricant is dispersed or dissolved therein while being heated to a temperature lower than the melting point of the organic binder in the surface of the powder additives, so there is no problem in using water as a dispersion medium or solvent. Accordingly, the coating process for the lubricant can be carried out at low cost. This reduction in cost is furthered by using water as a dispersion medium or solvent for applying the organic binder to the powder additive proper.

A surface-active agent or rust inhibitor may be added to the solvent or dispersion medium as necessary, particularly in the case of water. In the event that an organic solvent is to be used as a solvent or dispersion medium, alcohols are preferably used.

The reason that the preferred average primary particle size for the free lubricant used in the above-described aggregation-type lubricant mixing method is about 0.01 to about 80 μm and the preferably secondary particle size is about 10 to about 200 μm is as follows. In the event that the primary particle size is smaller than about 0.01 μm, the binding force between the particles becomes strong to the extent that the secondary particles formed by agglomeration of the primary particles are not readily crushed at the time of compacting the iron-based powder mixture and, accordingly, do not sufficiently scatter to the surface of the die cavity, meaning that the effects of lubrication decrease. On the other hand, in the event that the primary particle size exceeds about 80 μm, causing risk that primary particles remained in the compacted body following compaction may form large pores following sintering.

Also, in the event that the secondary particles are smaller than about 10 μm, the secondary particles are markedly smaller than the particle size of the iron-based powder particles, so the secondary particles intrude in the vacancies among the iron-based powder particles and the agglomeration thereof is not readily crushed, leading to difficulty of dispersing the primary particles throughout the iron-based powder mixture, and deteriorating lubrication effects. On the other hand, in the event that the secondary particles exceed about 200 μm, partially-agglomerated secondary particle structures remain even following crushing of the primary particle agglomeration, thereby causing the risk of large pores following sintering.

The average particle size of the primary particles can be achieved by managing the pulverization conditions with known pulverizing means, and the average particle size of the secondary particles can be achieved by managing the aggregation conditions with known means. For example, in case of a spray-drying method, the slurry of the primary particles is sprayed into a heated gas flow, the slurry comprising the solvent in which a polymer serving as the binding agent is dissolved. In this method, the desired particle size distribution can be obtained by controlling the concentration of the primary particles or the binding agent in the slurry, the size of the sprayed droplets, the temperature and velocity of the gas flow, and so forth.

Also, the above-described free lubricant is preferably added within a range of about 0.01 to about 2.0 parts by weight as to the iron-based powder mixture.

In the event that the amount of the free lubricant as to 100 parts per weight of the sum of the iron-based powder and the powder additive particles proper is less than about 0.01 parts per weight, the lubrication effects of the free lubricant are small. On the other hand, in the event that it exceeds about 2.0 parts per weight, the volume fraction of the lubricant in the iron-based powder mixture is high. This is undesirable, since this undermines the advantages of the invention regarding preventing excessive addition of lubricants, i.e., the advantages of the invention wherein problems, such as decrease in the density of the compacted body or deformation of the sintered parts due to increased dimensional shrinkage at the time of sintering, are suppressed.

Preferably used for the lubricant added on the primary mixing and the secondary mixing is one or more selected from the following: metallic soaps and their derivatives, such as zinc stearate, potassium stearate, lithium stearate, and lithium hydroxystearate; fatty acids such as oleic acid and palmitic acid; copolymer products of ethylene diamine and fatty acid, such as stearamide, ethylene bis-stearamide, copolymer product of ethylene diamine and sebacic acid, and so forth; and thermoplastic resin powder such as polyolefin or the like. The lubricant used in the primary mixing and the secondary mixing may be the same or may be different.

Figure 3:
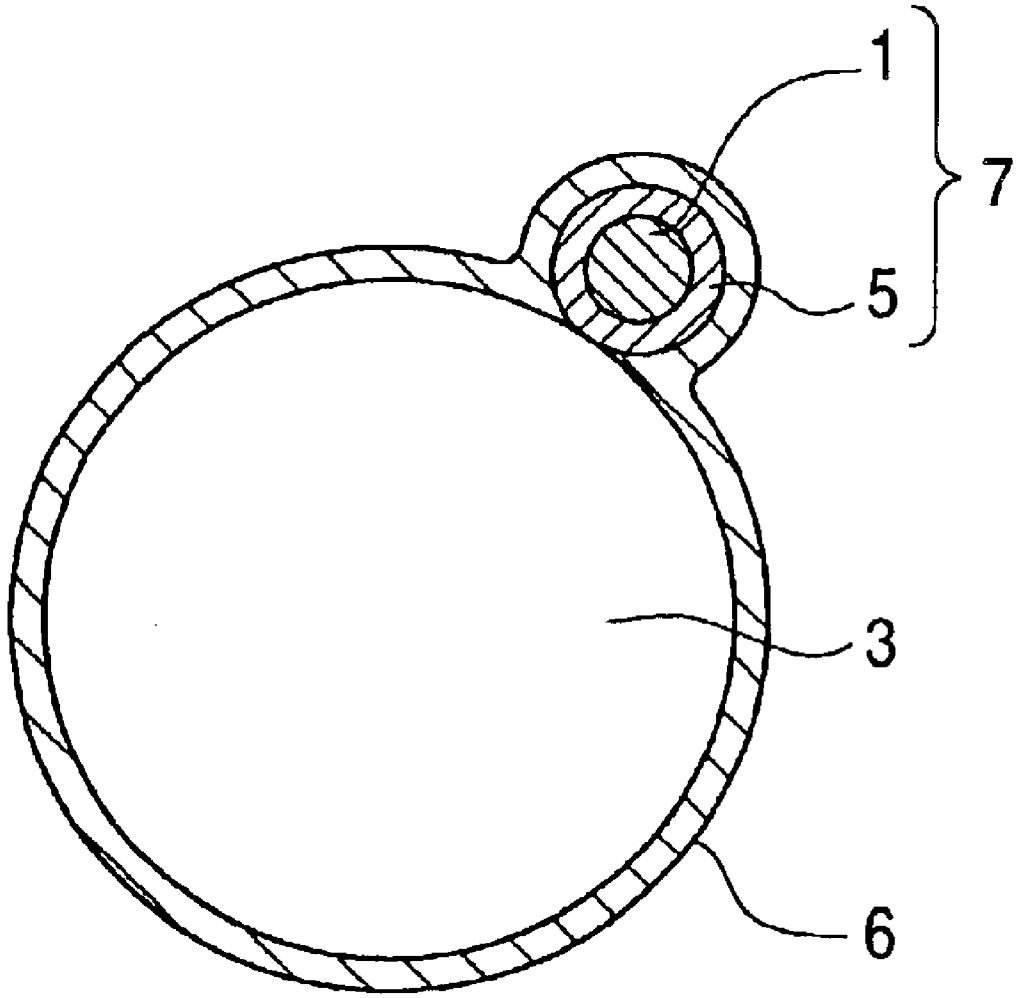
FIG. 3 is a model diagram illustrating another iron-based powder mixture for powder metallurgy according to aspects of the invention.

FIG. 3 is a model diagram illustrating a state wherein the entire face of an iron-based powder particle, to which powder additives have been bound, is covered with a lubricant by the coating method, described in item (1) above.

As shown in the drawing, with this coating method, the entire face of the iron-based powder particle 3 to which the powder-metallurgical powder additive 7 has been bound can be substantially uniformly coated with the lubricant (coating lubricant) 6, so not only can the flowability of the iron-based powder mixture be improved, but also, the ejection pressure from the die cavity is improved. Also, the distribution efficiency of the lubricant is the best, so the amount of lubricant added can be reduced as compared with conventional methods and, accordingly, the green density can be improved. In fact, the amount of lubricant and binder used can be reduced to about 50% or less as compared to the conventional dry mixing method (wherein a part of the lubricant is used for the binder), and to around about 70% as compared to the conventional wet mixing method (wherein a part of the lubricant is used for the binder).

Also, according to the aggregation-type lubricant mixing method described in item (2) above, not only do the secondary particles with relatively small particle size effectively intrude into the vacancies between the iron-based powder, but also in the event of charging a die cavity with the iron powder mixture, the secondary particles with relatively large particle size effectively intrude into the gaps between the surface of the die and the iron-based powder in contact therewith, thereby markedly improving the lubrication effects, so reduction in ejection force from the die and improved in green density can be realized at the same time. Further, the amount of lubricant required is less than that of conventional mixed powder manufacturing methods.

The method described in item (3) above is employed to balance the merits of both methods.

Also, it is crucial to mix with a low shearing force to not break the secondary particles of the free lubricant, when using the above-described aggregation-type lubricant mixing.

When using a powder mixer as the mixing means, allowing secondary particles with a particle size of about 10 to about 200 $\mu$m to remain at a percentage of about 20% by volume as to the total amount of free lubricant is preferred to achieve sufficient advantages of the aggregation-type lubricant method. A mixing powder mixer which applies little external force on the powder in the mixing operation is preferable for the powder mixer. "Powder Mixing Technology" (edited by The Association of Powder Process Industry and Engineering, Japan and published by The Nikkan Kogyo Shimbun, Ltd., 2001) describes on pages 33 through 35 that external force applied to the powder by the mixer according to the mixing operation is least for (I) diffusive mixing, then (II) convective mixing, and greatest for (III) shearing mixing. In this light a mixing method with external force around that of (I) or (II) is preferable.

Examples of preferred mixers include container-rotation mixers, mechanical stirring mixers, fluid stirring mixers, non-stirring mixers, and so forth, while high-speed shearing mixers and percussive mixers are unsuitable.

Suitable examples of container-rotation mixers include V-shaped mixers, double-cone mixers, and cylindrical mixers, and suitable examples of mechanical stirring mixers include uniaxial ribbon mixers, rotational plough-share mixers (Redig mixers, etc.), conical planet screw mixers (Nauta mixers, etc.), high-speed bottom-rotating mixers (Henschel mixers, etc.) and tilted rotational pan mixers (Eirich mixers, etc.).

When using a mechanical stirring mixer, stirring blades with a large surface area contribute to a larger shearing force and, accordingly, are not suitable. Rotations of the stirring blades and so forth should be slower than normal for the same reason. The velocity at the tip of the stirring blades is preferably about 60 m/min or slower.

The third aspect of the invention is the iron-based powder mixture for powder metallurgy, wherein the powder additive for powder metallurgy according to the first aspect is bound to the surface of the iron-based powder by the organic binder using the method according to the third aspect.

There is essentially no adhesion of organic binder on the surface of the iron-based powder of such iron-based powder mixture, except for the point of adhesion with the powder additives. Here, the term "essentially no adhesion" means at least 0.5% or less in terms of coating percentage.

As for the iron-based powder, any can be selected from the following: pure iron powder; completely alloyed steel powder wherein Cr, Mn, Ni, Mo, V, and the like, are alloyed with Fe; and partially alloyed steel powder wherein powder of Ti, Ni, Mo, Cu, and the like, is diffusion-bonded in pure iron powder or completely alloyed steel powder.

There is particularly no restriction on the amount of other alloy elements contained, as long as the presupposition of iron-based powder (Fe being about 50% by mass or more) is satisfied. Impurities of about 3 mass % or less in the iron-based powder are permissible. Typical impurity inclusion amounts are about 0.05% by mass or less for C, about 0.10% by mass or less for Si, about 0.50% by mass or less for Mn (in the event of not adding as an alloy element), about 0.03% by mass or less for P, about 0.03% by mass or less for S, about 0.30% by mass or less for O, and about 0.1% by mass or less for N.

The particle size of the iron-based powder is preferably around about 1 to about 200 $\mu$m, from the perspective of the object of powder metallurgy.

A desired amount of the powder additives coated with resin can be mixed into the iron-based powder basically as needed, within a realistic range for powder metallurgy. That is, powder with a specific gravity smaller than Fe, such as graphite powder, BN powder, MnS powder, and the like, can be mixed in the iron-based powder at a percentage of about 0.1 to about 20% by mass, preferably about 10% by mass or less, and powder with a specific gravity equal to or greater than that of Fe (primarily metal powder), such as copper powder, Ni-based powder, Mo-based powder, and the like, can be mixed in the iron-based powder at a percentage of about 0.1 to about 50% by mass, preferably about 30% by mass or less, and then the mixture is subjected to segregation-preventing treatment. The amount of the powder additives for powder metallurgy contained (% by mass) is the percentage thereof as to the total weight of the iron-based powder (primary raw material powder) and the powder additives particles proper.

In the event that the amount of powder additives contained therein is less than about 0.1% by mass, there is essentially no powder-metallurgical meaning of adding the powder additives. On the other hand, in the event of exceeding the above-described upper limits (i.e., about 20% by mass and about 50% by mass), the volume percentage of the powder additives becomes greater than the iron-based powder, which may defeat the presumption of this application that iron-based powder surely exists around the powder additive at the time of mixing. This would result in part of the powder additive not adhering to the surface of the iron-based powder, or excessive powder additive particles coated with organic binder adhering one to another and consequently agglomerating, leading to segregation of components more readily. The above-described preferable upper limits (i.e., about 10% by mass and about 30% by mass) or less should be used to reduce such phenomena as much as possible.

From the perspective of preventing segregation, iron-based powder is preferably made to adhere to approximately the entire amount of the powder additives mixed in.

In the fourth aspect, the lubricant is added as necessary. The lubricant added in the above-described primary mixing is added primarily to assist adhesion of the powder additive to the iron-based powder, so in the event that the organic binder coating the surface of the powder additives has sufficient adhesion, addition of the lubricant can be omitted or the amount thereof reduced.

Also, the lubricant added at the time of secondary mixing has advantages of improving the flowability of the mixture while reducing the ejecting pressure of the article from the die, so a needed amount is preferably added.

In any case, the mixed powder according to the invention prevents segregation of the powder additives within the iron-based powder mixture for powder metallurgy so that irregularities in size of the sintered material and irregularities in strength can be reduced. Moreover, the amount of lubricant added (also serving as binder) for sufficient adhesion of the powder additives for powder metallurgy with the conventional technique can be reduced to around 70%, so high-density compaction can be realized, which lends to high-density and high-strength materials.

The composition of the iron-based powder mixture for powder metallurgy is determined by the composition of the above-described raw materials and the amount of addition thereof, and there are no restrictions in particular.

The iron-based powder mixture for powder metallurgy according to the fourth aspect may be formed by conventional room temperature compaction or warm compaction, or may be compacted by conventional high-density compaction methods such as die lubricated compaction or forging, at room temperature or warm temperature. Articles compacted by room temperature compaction, warm compaction, die lubricated compaction, and the like, are sintered, and subjected as necessary to thermal processing such as carburizing and quenching, high-frequency quenching, bright quenching, and so forth, thereby yielding a sintered material.

Also, depending on the type of steel, sinter-hardening, wherein the article is rapidly cooled following sintering, may be performed. Further, the sintered material may be heated again, and hot-forged. With cold forging, the article compacted by high-pressure compaction at room temperature may be pre-sintered, forged at room temperature, and then subjected to main sintering.

FIRST EXAMPLE

The thermoplastic resins and waxes shown in Table 1 were prepared as organic binder to be provided to the powder additives. Also, as powder additives (particles proper), the graphite powders listed in Table 2, the copper powders listed in Table 3, the Ni-based powders listed in Table 4, and the Mo-based powders listed in Table 5 were prepared. Processing liquid wherein the organic binders listed in Tables 2 through 5 are made into a resin (or wax) emulsion or solution were added to the powder additive particles proper, mixed with an explosion-proof type Henschel mixer, and then dried in an explosion-proof type drying oven. The amount of organic binder (amount of solids) provided to the powder additives is also listed in Tables 2 through 5.

In cases where water was used as the dispersion medium, a surface-active agent was used for application to graphite powder, and a rust inhibitor was used for application to copper powder, Ni-based powder, and Mo-based powder.

The obtained dried cake was pulverized with a Henschel mixer, then classified with a sieve having sieve openings of 75 $\mu$m. The average particle size of the classified powder was measured with a Microtrac apparatus (more properly, a particle size analyzer utilizing laser diffraction/scattering), and 50% particle size (50% transmission culminative particle size) $d_{50}$ was obtained. See "Particle Size Measurement" (Terence Allen, published by Chapman and Hall, London) for example, for the measurement method.

Also, the mass of the volatile components was measured with a method wherein the classified powder is heated at a speed of 10° C./min in the atmosphere and the weight and heat generation thereof were measured (the TG-DTA method (thermogravimetry-differential thermal analysis)). The results are listed in Tables 2 through 5.

Also, Tables 2 through 5 list the results for the $d_{50}$ for the powder-metallurgical powder additives uncoated with organic resin, for comparison.

TABLE 1

| Type | Symbol | Name of substance | Melting point(° C.) | Softening point(° C.) |
|---|---|---|---|---|
| Thermo-plastic resin | A | Polyester resin | 146 | — |
| | B | Hydrophilic resin-covered Polyester resin | 124–130 | |
| | C | Linear-saturation polyester | 155 | — |
| | D | Denatured ether polyester | 123 | — |
| | E | Polypropylene resin | 165 | — |
| | F | Low-molecular-weight Polyethylene resin | 120–130 | — |
| | G | Butyral resin | 120 | — |
| | H | EVA resin | 135 | — |
| | I | Terpene phenol resin | 130 | — |
| | J | Terpene phenol resin | 145 | — |
| | K | Styrene-butadiene elastomer | — | >80 |
| | L | Styrene acrylate copolymer | 100–105 | — |
| | M | Acrylic resin | 115 | — |
| | N | Ester methacrylate copolymer | 160 | — |
| Wax | P | Polyethylene | 138 | — |
| | Q | Paraffin wax | 69 | — |
| | R | micro-crystalline wax | 101 | — |
| | S | Fischer-Tropsch wax | 98 | — |

TABLE 2

| | Powder additives for powder metallurgy | Resin Symbol | Resin Average particle size ($\mu$m) | Resin Solid content* (% by mass) | Wax Symbol | Wax Average particle size ($\mu$m) | Wax Solid content* (% by mass) | Processing liquid Liquid type | Processing liquid Solvent/ Dispersion medium | Processing liquid $d_{50}$ ($\mu$m) | Processing liquid Volatile content (% by mass) | Processing liquid Form of providing binder |
|---|---|---|---|---|---|---|---|---|---|---|---|---|
| Invention example S1 | Natural graphite powder | I | 0.1 | 5 | — | — | — | Emulsion | Water | 19 | 5 | Interspersed over entire surface |
| Invention | Natural | J | 0.1 | 10 | — | — | — | Emulsion | Water | 5 | 10 | Interspersed |

TABLE 2-continued

| | Powder additives for powder metallurgy | Resin Symbol | Resin Average particle size (μm) | Resin Solid content* (% by mass) | Wax Symbol | Wax Average particle size (μm) | Wax Solid content* (% by mass) | Processing liquid Liquid type | Processing liquid Solvent/ Dispersion medium | $d_{50}$ (μm) | Volatile content (% by mass) | Form of providing binder |
|---|---|---|---|---|---|---|---|---|---|---|---|---|
| example S2 | graphite powder | | | | | | | | | | | over entire surface |
| Invention example S3 | Earthy graphite powder | I | 0.1 | 15 | P | 0.2 | 5 | Emulsion | Water | 5 | 20 | Interspersed over entire surface |
| Invention example S4 | Synthetic graphite powder | J | 0.1 | 10 | R | 0.4 | 5 | Emulsion | Water | 7 | 15 | Interspersed over entire surface |
| Invention example S5 | Spherulite | F | 0.2 | 8 | Q | 0.1 | 2 | Emulsion | Water | 20 | 10 | Interspersed over entire surface |
| Invention example S2b | Natural graphite powder | I | 0.4 | 10 | — | — | — | Emulsion | Ethanol | 5 | 10 | Interspersed over entire surface |
| Invention example S17 | Natural graphite powder | — | — | — | Q | 0.1 | 10 | Emulsion | Water | 5 | 10 | Interspersed over entire surface |
| Comparative Example S1 | Natural graphite powder | — | — | — | — | — | — | — | — | 19 | — | — |
| Comparative Example S2 | Natural graphite powder | — | — | — | — | — | — | — | — | 5 | — | — |
| Comparative Example S3 | Earthy graphite powder | — | — | — | — | — | — | — | — | 5 | — | — |
| Comparative Example S4 | Synthetic graphite powder | — | — | — | — | — | — | — | — | 7 | — | — |
| Comparative Example S5 | Spherulite | — | — | — | — | — | — | — | — | 20 | — | — |

*Solid content: value as to powder additives following binder-providing process

TABLE 3

| | Powder additives for powder metallurgy | Resin Symbol | Resin Average particle size (μm) | Resin Solid content* (% by mass) | Wax Symbol | Wax Average particle size (μm) | Wax Solid content* (% by mass) | Processing liquid Liquid type | Processing liquid Solvent/ Dispersion medium | $d_{50}$ (μm) | Volatile content (% by mass) | Form of providing binder |
|---|---|---|---|---|---|---|---|---|---|---|---|---|
| Invention example S6 | Atomized copper powder | B<br>C | 0.1<br>0.5 | 5<br>5 | — | — | — | Emulsion | Water | 25 | 10 | Coating |
| Invention example S7 | Electrolytic copper powder | F<br>H | 0.1<br>0.2 | 9<br>9 | S | 0.2 | 2 | Emulsion | Water | 23 | 20 | Coating |
| Invention example S8 | Oxide-reduced copper powder | D | 0.3 | 12 | P | 0.2 | 3 | Emulsion | Isopropyl alcohol | 0.9 | 15 | Coating |
| Invention example S9 | Cuprous oxide powder | E | 0.1 | 10 | Q | 0.1 | 5 | Emulsion | Isopropyl alcohol | 1.1 | 15 | Coating |
| Comparative Example S6 | Atomized copper powder | — | — | — | — | — | — | — | — | 25 | — | — |
| Comparative Example S7 | Electrolytic copper powder | — | — | — | — | — | — | — | — | 23 | — | — |
| Comparative Example S8 | Oxide-reduced copper powder | — | — | — | — | — | — | — | — | 0.9 | — | — |

TABLE 3-continued

| | Powder additives for powder metallurgy | Resin Symbol | Resin Average particle size (μm) | Resin Solid content* (% by mass) | Wax Symbol | Wax Average particle size (μm) | Wax Solid content* (% by mass) | Processing liquid Liquid type | Processing liquid Solvent/ Dispersion medium | $d_{50}$ (μm) | Volatile content (% by mass) | Form of providing binder |
|---|---|---|---|---|---|---|---|---|---|---|---|---|
| Comparative Example S9 | Cuprous oxide powder | — | — | — | — | — | — | — | — | 1.1 | — | — |

*Solid content: value as to powder additives following binder-providing process

TABLE 4

| | Powder additives for powder metallurgy | Resin Symbol | Resin Average particle size (μm) | Resin Solid content* (% by mass) | Wax Symbol | Wax Average particle size (μm) | Wax Solid content* (% by mass) | Processing liquid Liquid type | Processing liquid Solvent/ Dispersion medium | $d_{50}$ (μm) | Volatile content (% by mass) | Form of providing binder |
|---|---|---|---|---|---|---|---|---|---|---|---|---|
| Invention example S10 | Atomized Ni powder | M<br>F | 0.1<br>0.1 | 4<br>4 | P | 0.2 | 2 | Emulsion | Water | 22 | 10 | Coating |
| Invention example S11 | Carbonyl Ni powder | G | 0.2 | 15 | Q | 0.1 | 5 | Emulsion | Water | 4 | 20 | Coating |
| Invention example S12 | Oxide-reduced Ni powder | H | 0.3 | 15 | S | 0.2 | 5 | Emulsion | Water | 1 | 20 | Coating |
| Invention example S13 | 60% Ni-40% Fe powder | K | 0.5 | 4 | R | 0.4 | 1 | Emulsion | Water | 30 | 5 | Coating |
| Comparative Example S10 | Atomized Ni powder | — | — | — | — | — | — | — | — | 22 | — | — |
| Comparative Example S11 | Carbonyl Ni powder | — | — | — | — | — | — | — | — | 4 | — | — |
| Comparative Example S12 | Oxide-reduced Ni powder | — | — | — | — | — | — | — | — | 1 | — | — |
| Comparative Example S13 | 60% Ni-40% Fe powder | — | — | — | — | — | — | — | — | 30 | — | — |

*Solid content: value as to powder additives following binder-providing process

TABLE 5

| | Powder additives for powder metallurgy | Resin Symbol | Resin Average particle size (μm) | Resin Solid content* (% by mass) | Wax Symbol | Wax Average particle size (μm) | Wax Solid content* (% by mass) | Processing liquid Liquid type | Processing liquid Solvent/ Dispersion medium | $d_{50}$ (μm) | Volatile content (% by mass) | Form of providing binder |
|---|---|---|---|---|---|---|---|---|---|---|---|---|
| Invention example S14 | Atomized Mo powder | L | 0.1 | 4 | P | 0.2 | 1 | Emulsion | Water | 50 | 5 | Coating |
| Invention example S15 | Oxide-reduced Mo powder | A | 0.2 | 10 | Q | 0.4 | 5 | Emulsion | Water | 0.8 | 15 | Coating |
| Invention example S16 | 60% Mo-40% Fe powder | N<br>F | 0.2<br>0.2 | 3<br>5 | R | 0.4 | 2 | Emulsion | Water | 45 | 10 | Coating |
| Comparative Example S14 | Atomized Mo powder | — | — | — | — | — | — | — | — | 50 | — | — |
| Comparative Example S15 | Oxide-reduced Mo powder | — | — | — | — | — | — | — | — | 0.8 | — | — |
| Comparative Example S16 | 60% Mo-40% Fe powder | — | — | — | — | — | — | — | — | 45 | — | — |

*Solid content: value as to powder additives following binder-providing process

The Invention examples S1 through S5 and S2b, and the Comparative examples S1 through S5, shown in Table 2, the Invention examples S6 through S9 and the Comparative examples S6 through S9 shown in Table 3, the Invention examples S10 through S13 and the Comparative examples S10 through S13 shown in Table 4, and the Invention examples S14 through S16 and the Comparative examples S14 through S16 shown in Table 5, were each compared, and it was found that the average particle size of each of the powder additives was the same before coating with the organic resin. It is noted that, the amount of volatile content within the powder additives for powder metallurgy following coating with the organic resin had the same ratio as the quantity of the solid resin component added as an ingredient. Thus, it was confirmed that each powder additives for powder metallurgy was provided with the predetermined amount of organic resin, with no agglomeration.

SECOND EXAMPLE

Atomized pure iron powder (KIP (TM) 301A: a product by JFE Steel Corp.), reduced iron powder (KIP (TM) 255M), 4% Ni by mass—1.5% Cu by mass—0.5% Mo by mass partially alloyed steel powder (KIP (TM) SIGMALOY 415S), 2% Ni by mass—1% Mo by mass partially alloyed steel powder (KIP (TM) SIGMALOY 2010), and 3% Cr by mass—0.3% V by mass completely alloyed steel powder (KIP (TM) 30CRV), were prepared as iron-based powder. Also, the graphite powder according to Invention examples S1 through S5 and Comparative examples S1 through S5 in the first Example were prepared as powder additives. The iron-based powder and the powder additive were mixed in a Henschel mixer at a predetermined temperature, thereby making an iron-based mixed powder for powder metallurgy. The types of iron-based powder used and the types of graphite powder, the amounts added, and the heat mixing temperature, are as shown in Table 6.

Note that the Ni, Cu, and Mo within the KIP (TM) SIGMALOY 415S were each added by diffusion bonding process wherein alloy powder was dispersed in the iron powder to bond thereto. This is the same for the Ni and Mo in the KIP (TM) SIGMALOY 2010, as well. The amounts of impurities other that those described above were: 0.05% by mass or less of C, 0.10% by mass or less of Si, 0.50% by mass or less of Mn, 0.03% by mass or less of P, 0.03% by mass or less of S. 0.30% by mass or less of O, and 0.1% by mass or less of N.

The amount of carbon in the obtained iron-based powder mixture for powder metallurgy was analyzed by infrared absorption method after combustion in induction furnace. Further, the powder was classified with a sieve having sieve openings of 75 $\mu$m and 150 $\mu$m, and the amount of carbon in the iron-based powder mixture for powder metallurgy of 75 $\mu$m to 150 $\mu$m (i.e., the powder which passed through the 150 $\mu$m sieve, but did not pass through the 75 $\mu$m sieve) was also analyzed by combustion—infrared absorption. The adhesion of graphite was calculated from the following Expression 1 using these measurement amounts for carbon. The adhesion of graphite are indicators representing segregation of graphite powder, and the greater the value is, this indicates the more graphite has adhered to the iron-based powder and the segregation thereof is small.

Expression 1

$$\text{Graphite adhesion (\%)}=100\ (C_{75\text{-}150}/C_{total})$$

wherein $C_{75\text{-}150}$ is the amount (% by mass) of carbon within the iron-based powder mixture 75 $\mu$m to 150 $\mu$m, and wherein $C_{total}$ is the amount (% by mass) of carbon within the unclassified iron-based powder mixture.

The results obtained are shown in Table 6.

TABLE 6

| | Iron-based powder | Graphite powder: Type | Graphite powder: Mixing amount* (% by mass) | Graphite powder: Lowest melting point of organic binder (° C.) | Heat mixing temperature(° C.) | Adhesion of graphite(%) |
|---|---|---|---|---|---|---|
| Invention example M1 | 255M | Invention example S1 | 0.8 | 130 | 155 | 89 |
| Invention example M2 | 301A | Invention example S3 | 0.8 | 130 | 140 | 95 |
| Invention example M3 | 415S | Invention example S2 | 0.3 | 145 | 160 | 98 |
| Invention example M4 | 2010 | Invention example S1 | 0.6 | 130 | 145 | 90 |
| Invention example M5 | 30CRV | Invention example S5 | 1.0 | 69 | 140 | 85 |
| Invention example M6 | 2010 | Invention example S4 | 0.6 | 101 | 130 | 94 |
| Comparative example M1 | 255M | Comparative example S1 | 0.8 | — | 155 | 22 |
| Comparative example M2 | 301A | Comparative example S3 | 0.8 | — | 140 | 24 |
| Comparative example M3 | 415S | Comparative example S2 | 0.3 | — | 160 | 21 |
| Comparative example M4 | 2010 | Comparative example S1 | 0.6 | — | 145 | 25 |
| Comparative example M5 | 30CRV | Comparative example S5 | 1.0 | — | 140 | 23 |
| Comparative example M6 | 2010 | Comparative example S4 | 0.6 | — | 130 | 23 |

*Mixing amount: amount of powder additives proper as to total amount of iron-based powder and powder additives proper As shown in Table 6, the iron-based powder mixtures for powder metallurgy wherein graphite with organic binder provided thereto beforehand was used and heated to the melting point or softening point of the organic binder while mixing (i.e., the Invention examples M1 through M6) is exhibited markedly higher graphite adhesion as compared to those wherein organic binder was not provided to the graphite powder (i.e., the Comparative examples M1 through M6). It is noted that, with the Comparative examples, graphite powder which was smaller than the sieve, but did not fall through the sieve increases the superficial graphite adhesion.

Thus, it can be understood that providing thermoplastic resin or the like, which is an organic binder to the graphite powder, and further temporarily melting the thermoplastic resin by heating and mixing effectively causes the graphite powder to adhere to the iron-based powder, thus, preventing segregation.

THIRD EXAMPLE

Atomized pure iron powder (KIP (TM) 301A and KIP 304A), reduced iron powder (KIP (TM) 255M), 4% Ni by mass—1.5% Cu by mass—0.5% Mo by mass partially alloyed steel powder (KIP (TM) SIGMALOY 415S), 2% Ni by mass—1% Mo by mass partially alloyed steel powder (KIP (TM) SIGMALOY 2010), and 3% Cr by mass—0.3% V by mass completely alloyed steel powder (KIP (TM) 30CRV), were prepared as iron-based powder. Also, the graphite powder according to Invention examples S1 through S4 and S2b and Comparative examples S1 through S4 in the first Example; the copper powders according to Invention examples S6, S7, and S9, and Comparative examples S6, S7, and S9, in the first Example; the Ni powder according to Invention example S11 and Comparative example S11 in the first Example; and the Mo—Fe powder according to Invention example S16 and Comparative example S16 in the first Example; were prepared as powder additives.

The iron-based powder, graphite powder which is a powder additive, and at least one type of the powder additives, i.e., the copper powder, Ni powder, or Mo—Fe powder, as desired, were mixed with a primary mixing lubricant at the compounding ratio shown in Table 7. Next, the powder was mixed with a Henschel mixer 2 liters in capacity and with a stirring blade diameter of 20 cm, with no chopper, while heating to 130 to 160° C., following which the powder was cooled, and at the point that the powder cooled to 60° C. (the temperature lower than the melting point of the secondary mixing lubricant) the secondary mixing lubricant shown in Table 7 was added and mixed, thus making an iron base mixed powder for powder metallurgy. The heating temperature for mixing in the primary mixing lubricant is a temperature equal to or higher than the melting point or the softening point of the thermoplastic resin or the like provided to the graphite powder, copper powder, Ni powder, and Mo—Fe powder, and higher than all lubricants in the primary mixing lubricant, and is a temperature sufficient for melting or softening at least one of them.

TABLE 7

| | | Powder additives | | | | | | | | | | | | Primary mixing lubricant | | Secondary mixing lubricant | | Heat | Binder + |
|---|---|---|---|---|---|---|---|---|---|---|---|---|---|---|---|---|---|---|---|
| | | Graphite | | | Copper powder | | | Ni powder | | | Mo-Fe Powder | | | | | | | | |
| | Iron-based powder | Type | Lowest melting point *2 (° C.) | Mixing amount *3 (% by mass) | Type | Lowest melting point *2 (° C.) | Mixing amount *3 (% by mass) | Type | Lowest melting point *2 (° C.) | Mixing amount *3 (% by mass) | Type | Lowest melting point *2 (° C.) | Mixing amount *3 (% by mass) | Type *1 | Adding amount *4 (parts by weight) | Type *1 | Adding amount *4 (parts by weight) | mixing temperature (° C.) | lubricant (total amount) *4 (parts by weight) |
| Invention Example M7 | 255M | Invention Example S4 | 101 | 0.8 | Invention Example S6 | 124 | 2 | — | — | — | — | — | — | a<br>b | 0.1<br>0.35 | b | 0.4 | 155 | 1.21 |
| Invention Example M8 | 301A | Invention Example S1 | 130 | 0.8 | Invention Example S7 | 98 | 2 | — | — | — | — | — | — | a<br>b | 0.1<br>0.35 | b | 0.4 | 140 | 1.39 |
| Invention Example M9 | 304A | Invention Example S2 | 145 | 0.3 | — | — | — | — | — | — | Invention Example S16 | 101 | 1 | — | — | b | 0.6 | 160 | 0.74 |
| Invention Example M10 | 304A | Invention Example S3 | 130 | 0.5 | Invention Example S9 | 69 | 1.5 | Invention Example S11 | 69 | 4 | Invention Example S16 | 101 | 0.5 | — | — | b | 0.6 | 165 | 2.05 |
| Invention Example M11 | SIGMALOY 415S | Invention Example S1 | 130 | 0.5 | — | — | — | — | — | — | — | — | — | — | — | b | 0.6 | 160 | 0.63 |
| Invention Example M12 | SIGMALOY 415S | Invention Example S2 | 145 | 0.5 | — | — | — | — | — | — | — | — | — | — | — | b | 0.6 | 155 | 0.66 |
| Invention Example M13 | 30CRV | Invention Example S2 | 145 | 1.0 | — | — | — | — | — | — | — | — | — | b<br>c | 0.2<br>0.2 | c | 0.4 | 160 | 0.91 |
| Invention Example M14 | 30CRV | Invention Example S2 | 145 | 1.0 | — | — | — | — | — | — | — | — | — | — | — | c | 0.4 | 160 | 0.51 |
| Invention Example M15 | SIGMALOY 415S | Invention Example S2 | 145 | 0.3 | — | — | — | — | — | — | — | — | — | d<br>c | 0.1<br>0.2 | e | 0.3 | 160 | 0.63 |
| Invention Example M16 | SIGMALOY 415S | Invention Example S2 | 145 | 0.3 | — | — | — | — | — | — | — | — | — | — | — | c | 0.5 | 160 | 0.53 |
| Invention Example M17 | SIGMALOY 2010 | Invention Example S2 | 145 | 0.3 | — | — | — | — | — | — | — | — | — | — | — | c | 0.5 | 160 | 0.53 |
| Invention Example M18 | 304A | Invention Example S2 | 145 | 0.8 | Comparative Example S7 | — | 2 | — | — | — | — | — | — | — | — | e | 0.6 | 160 | 0.69 |
| Invention Example M18b | 304A | Invention Example S2b | 130 | 0.8 | Comparative Example S7 | — | 2 | — | — | — | — | — | — | — | — | e | 0.6 | 160 | 0.69 |
| Comparative Example M7 | 255M | Comparative Example S4 | — | 0.8 | Comparative Example S6 | — | 2 | — | — | — | — | — | — | a<br>b | 0.1<br>0.35 | b | 0.4 | 155 | 0.85 |
| Comparative Example M8 | 301A | Comparative Example S1 | — | 0.8 | Comparative Example S7 | — | 2 | — | — | — | — | — | — | a<br>b | 0.1<br>0.35 | b | 0.4 | 140 | 0.85 |
| Comparative Example M9 | 304A | Comparative Example S2 | — | 0.3 | — | — | — | — | — | — | Comparative Example S16 | — | 1 | — | — | b | 0.6 | 160 | 0.60 |
| Comparative Example M10 | 304A | Comparative Example S3 | — | 0.5 | Comparative Example S9 | — | 1.5 | Comparative Example S11 | — | 4 | Comparative Example S16 | — | 0.5 | — | — | b | 0.6 | 165 | 0.60 |

TABLE 7-continued

| | | Powder additives | | | | | | | | | | | | Primary mixing lubricant | | Secondary mixing lubricant | | Heat | Binder + |
|---|---|---|---|---|---|---|---|---|---|---|---|---|---|---|---|---|---|---|---|
| | | Graphite | | | Copper powder | | | Ni powder | | | Mo-Fe Powder | | | | Adding | | Adding | mix- | lubricant |
| | Iron-based powder | Type | Lowest melting point *2 (° C.) | Mixing amount *3 (% by mass) | Type | Lowest melting point *2 (° C.) | Mixing amount *3 (% by mass) | Type | Lowest melting point *2 (° C.) | Mixing amount *3 (% by mass) | Type | Lowest melting point *2 (° C.) | Mixing amount *3 (% by mass) | Type *1 | amount *4 (parts by weight) | Type *1 | amount *4 (parts by weight) | ing temperature (° C.) | (total amount) *4 (parts by weight) |
| Comparative Example M11 | SIGMALOY 415S | Comparative Example S1 | — | 0.5 | — | — | — | — | — | — | — | — | — | — | — | b | 0.6 | 160 | 0.60 |
| Comparative Example M12 | SIGMALOY 415S | Comparative Example S2 | — | 0.5 | — | — | — | — | — | — | — | — | — | — | — | b | 0.6 | 155 | 0.60 |
| Comparative Example M13 | 30CRV | Comparative Example S2 | — | 1.0 | — | — | — | — | — | — | — | — | — | b<br>c | 0.2<br>0.2 | c | 0.4 | 160 | 0.80 |
| Comparative Example M14 | 30CRV | Comparative Example S2 | — | 1.0 | — | — | — | — | — | — | — | — | — | — | — | c | 0.4 | 160 | 0.40 |
| Comparative Example M15 | SIGMALOY 415S | Comparative Example S2 | — | 0.3 | — | — | — | — | — | — | — | — | — | d<br>e | 0.1<br>0.2 | e | 0.3 | 160 | 0.60 |
| Comparative Example M16 | SIGMALOY 415S | Comparative Example S2 | — | 0.3 | — | — | — | — | — | — | — | — | — | — | — | e | 0.5 | 160 | 0.50 |
| Comparative Example M17 | SIGMALOY 2010 | Comparative Example S2 | — | 0.3 | — | — | — | — | — | — | — | — | — | — | — | e | 0.5 | 160 | 0.50 |
| Comparative Example M18 | 304A | Comparative Example S2 | — | 0.8 | Comparative Example S7 | — | 2 | — | — | — | — | — | — | — | — | e | 0.6 | 160 | 0.60 |
| Comparative Example M13b | 30CRV | Comparative Example S2 | — | 1.0 | — | — | — | — | — | — | — | — | — | b<br>c | 0.4<br>0.3 | c | 0.4 | 160 | 1.10 |
| Comparative Example M15b | SIGMALOY 415S | Comparative Example S2 | — | 0.3 | — | — | — | — | — | — | — | — | — | d<br>e | 0.3<br>0.5 | e | 0.3 | 160 | 1.10 |

*1 Type a: Oleic acid (melting point: 16° C.), b: zinc stearate (melting point: 127° C.), c: stearamide (melting point: 99 to 105° C.), d: calcium stearate (melting point: 150 to 155° C.), e: lithium stearate (melting point: 213° C.)
*2 Lowest melting point: melting point or softening point of organic binder which has the lowest melting point or softening point
*3 Mixing amount: amount of powder additives (proper) as to total of iron-based powder and powder additives proper
*4 Adding amount, total amount: value as to a total of 100 parts by weight of iron-based powder and powder additives proper.

The graphite adhesion of the iron-based mixed powder for powder metallurgy was calculated by the same method as that described in the second Example.

Also, Cu adhesion, Ni adhesion, and Mo adhesion was obtained by the following methods.

The amount of Cu, the amount of Ni, and the amount of Mo in the obtained iron-based mixed powder for powder metallurgy was measured by atomic absorption analysis. Further, the powder was classified with 75 μm and 150 μm sieves, and the amount of Cu, the amount of Ni, and the amount of Mo in the obtained iron-based mixed powder of 75 to 150 μm was measured by atomic absorption analysis. The Cu adhesion, Ni adhesion, and Mo adhesion was calculated from the following Expression 2, using the amount of Cu, the amount of Ni, and the amount of Mo thus obtained.

Expression 2

$$\text{M adhesion } (\%) = 100\ (M_{75\text{-}150}/M_{total})$$

wherein M is Cu, Ni, or Mo, wherein $M_{75\text{-}150}$ is the amount (% by mass) of M within the iron-based powder mixture for powder metallurgy 75 μm to 150 μm, and wherein $M_{total}$ is the amount (% by mass) of M within the unclassified iron-based powder mixture for powder metallurgy.

Further, the iron based mixed powder for powder metallurgy was compacted in a tablet-shaped die with an inner diameter of 11 mm at a pressure of 686 MPa, and the green density of the green compact was measured.

The results obtained are shown in Table 8.

TABLE 8

| | Graphite adhesion (%) | Cu adhesion (%) | Ni adhesion (%) | Mo adhesion (%) | Compaction temperature (° C.) | Green density (Mg/m³) |
|---|---|---|---|---|---|---|
| Invention example M7 | 99 | 95 | — | — | 25 | 7.06 |
| Invention example M8 | 93 | 93 | — | — | 25 | 7.09 |
| Invention example M9 | 100 | — | — | 100 | 25 | 7.15 |
| Invention example M10 | 99 | 85 | 91 | 99 | 25 | 7.24 |
| Invention example M11 | 96 | 89* | 93* | 99* | 25 | 7.24 |
| Invention example M12 | 99 | 89* | 93* | 99* | 25 | 7.23 |
| Invention example M13 | 99 | — | — | — | 25 | 7.09 |
| Invention example M14 | 97 | — | — | — | 25 | 7.11 |
| Invention example M15 | 99 | 89* | 95* | 99* | 130 | 7.32 |
| Invention example M16 | 98 | 89* | 95* | 99* | 130 | 7.35 |
| Invention example M17 | 98 | — | 93* | 98* | 130 | 7.34 |
| Invention example M18 | 98 | 78 | — | — | 130 | 7.30 |
| Invention example M18b | 97 | 75 | — | — | 130 | 7.29 |
| Comparative example M7 | 75 | 55 | — | — | 25 | 7.05 |
| Comparative example M8 | 58 | 50 | — | — | 25 | 7.10 |
| Comparative example M9 | 81 | — | — | 85 | 25 | 7.15 |
| Comparative example M10 | 82 | 55 | 72 | 83 | 25 | 7.25 |
| Comparative example M11 | 78 | 89* | 93* | 99* | 25 | 7.24 |
| Comparative example M12 | 76 | 89* | 93* | 99* | 25 | 7.23 |
| Comparative example M13 | 85 | — | — | — | 25 | 7.10 |
| Comparative example M14 | 72 | — | — | — | 25 | 7.11 |
| Comparative example M15 | 85 | 89* | 95* | 99* | 130 | 7.32 |
| Comparative example M16 | 76 | 89* | 95* | 99* | 130 | 7.36 |
| Comparative example M17 | 77 | — | 93* | 98* | 130 | 7.35 |
| Comparative example M18 | 78 | 50 | — | — | 130 | 7.28 |
| Comparative example M13b | 98 | — | — | — | 25 | 7.01 |

TABLE 8-continued

| | Graphite adhesion (%) | Cu adhesion (%) | Ni adhesion (%) | Mo adhesion (%) | Compaction temperature (° C.) | Green density ($Mg/m^3$) |
|---|---|---|---|---|---|---|
| Comparative example M15b | 99 | 89* | 95* | 99* | 130 | 7.22 |

*Alloying or partial alloying in iron-based powder

As shown in Table 8, the iron-based mixed powders for powder metallurgy using the graphite, Cu powder, Ni powder, or Mo—Fe powder to which organic binder has been provided beforehand (Invention examples M7 through M18, M18b) each have greater adhesion of the powder additives (i.e., graphite adhesion, Cu adhesion, Ni adhesion, and Mo adhesion) as compared to those not provided with the organic binder (Comparative examples M7 through M18). Accordingly, it can be understood that with each of the Invention examples, the powder additives adhere to the iron-based powder in a more sure manner than with the Comparative examples, thus suppressing segregation.

Also, even in the event of not using the primary mixing lubricant which acts to assists bonding between the iron-based powder and the powder additives (Invention examples M9 through M12, M14, M16 through M18, and M18b), the adhesion of the powder additives was found to be great, with the powder additives adhering to the iron-based powder in a sure manner, and with segregation suppressed. Further, taking a closer look at Invention example M13 and Comparative examples M13 and M13b, and Invention example M14 and Comparative example M14, omitting the primary mixing lubricant melted by heating to serve as a binder (Invention example M14 and Comparative example M14) improves the green density over that of the arrangement wherein the primary mixing lubricant is added (Invention example M13 and Comparative example M13) in the same manner, but the adhesion of the graphite deteriorates with the Comparative example to a level unsatisfactory for a powder-metallurgy iron-based powder. Accordingly, it can be understood that the iron-based powder mixture for powder metallurgy using graphite to which the organic binder has been provided beforehand can realize both high graphite adhesion and high green density at the same time. Further, in the event of not providing the organic binder beforehand, and attempting to obtain graphite adhesion close to that of the invention (Invention example M14 wherein the primary mixing lubricant is not added) with the primary mixing lubricant alone requires twice or more of the total amount of lubricant and binder as compared with the invention as can be understood from the Comparative example M13b, leading to markedly deteriorated green density.

The same can be said for comparisons made between Invention examples M15 and M16 and Comparative examples M15, M16, and M15b.

Also, comparing Invention example M10 and Invention example M16, in the event that the amount of Cu, the amount of Ni, and the amount of Mo are the same within the iron-based mixed powder, the Cu adhesion, Ni adhesion, and Mo adhesion of Invention example M10 wherein Cu powder, Ni powder, and Mo powder, coated with organic binder beforehand are as high as around that of the partially alloyed steel powder (Invention example M16) wherein the Cu, Ni, and Mo have been adhered to the surface of the iron-based powder by thermal diffusion, thus showing that the iron-based powder mixture wherein the Cu powder, Ni powder, and Mo powder have been coated with organic binder beforehand can serve as a substitute for partially alloyed steel powder.

Further, comparing Invention example M18 or Invention example 18Mb with Comparative example M18, even though the only powder additive to which binder has been applied beforehand is the graphite powder, and though the copper powder has not been subjected to such processing, i.e., coating with the binder, the adhesion of not only the graphite but also of the copper is improved in the Invention example. This shows that in the case of an iron-based powder mixture containing multiple additives, coating at least one type of additive with the binder beforehand causes the untreated additives to also adhere, thus improving the adhesion of the other additives, as well.

FOURTH EXAMPLE

An iron-based mixed powder for powder metallurgy was made in the same way as with the third Example, except that the primary mixing lubricant and the secondary mixing lubricant shown in Table 7 were not used.

Next, after adding a free lubricant shown in Table 9 in various ranges, the powder was mixed with powder mixers of various types as shown in Table 10, thus preparing various types of iron-based mixed powder for powder metallurgy.

Table 10 also shows the results of checking the flowability, ejection pressure, and green density of the iron-based mixed powder for powder metallurgy thus obtained.

The properties were evaluated as follows.

(1) Percentage of Secondary Particles Following Mixing

The lubricant is observed in a scanning electron microscope (SEM) reflection electron image as low-contrast particles corresponding to light element components. Accordingly, the image was analyzed for only the low-contrast particles, and the percentage by volume of the secondary structure particles with particle size 10 to 200 $\mu$m in the lubricant was obtained.

(2) Flowability

An amount of 50 g of the iron-based powder mixture was filled in a container with an orifice diameter of 2.63 mm, and the flowability (s/50 g) was obtained by measuring the amount of time during discharging the whole of powder, thereby evaluating the flowability.

(3) Ejection Pressure and Green Density

The iron-based powder mixture was packed in a die, compressed under a pressure of 7 $ton/cm^2$ (686 MPa) so as to form a tablet (green compact) of 11.3 mm in diameter and 11 mm in hight, which was ejected from the die, and the force required for the ejection was used for evaluation. Ejection pressure was obtained by deviding the ejection force by an area of the side of the tablet contacting the die wall.

Also, the density of the obtained green compact is estimated as the green compact density.

TABLE 9

| Symbol | Type of free lubricant |
|---|---|
| A | Zinc stearate |
| B | Lithium stearate |

TABLE 9-continued

| Symbol | Type of free lubricant |
|---|---|
| C | Stearamide |
| D | Ethylene bis-stearamide |
| E | eutectic mixture of Ethylene bis-stearamide and polyethylene |

TABLE 9-continued

| Symbol | Type of free lubricant |
|---|---|
| F | Polyolefine (molecular weight 725) |
| G | eutectic mixture of Ethylene bis-stearamide and Polyolefine (molecular weight 725) |

TABLE 10

| | Iron-based powder and powder additives | Free lubricant Type | Free lubricant Primary particle average size (μm) | Free lubricant Secondary particle average size (μm) | Free lubricant Adding amount *1 (Parts by weight) | Type of mixer (Stirring blade rotations in parenthesis) | Percentage of secondary particles following mixing *2 (% by vol) | Properties Flowability (s/50 g) | Properties Ejection pressure (MPa) | Properties Green density (Mg/m$^3$) | Properties Aspect of green compact |
|---|---|---|---|---|---|---|---|---|---|---|---|
| Invention example M18d | Invention example M18b | A, D | 0.1 | 100 | 0.3 | V-shaped blender | 60 | 24.3 | 18 | 7.33 | Satisfactory |
| Invention example M13c | Invention example M13 | C, D | 1.0 | 200 | 0.4 | ” | 65 | 24.6 | 18 | 7.03 | Satisfactory |
| Invention example M18c | Invention example M18 | E | 0.05 | 20 | 0.5 | Redig mixer | 50 | 26.3 | 19 | 7.30 | Satisfactory |
| Invention example M15c | Invention example M15 | B | 5 | 80 | 1.5 | Rotation double conical | 40 | 25.5 | 20 | 7.22 | Satisfactory |
| Invention example M7c | Invention example M7 | D | 1.0 | 20 | 1.0 | Uniaxial ribbon | 80 | 24.1 | 12 | 7.25 | Satisfactory |
| Invention example M8c | Invention example M8 | G | 0.1 | 20 | 0.6 | Conical planet | 35 | 27.3 | 15 | 7.28 | Satisfactory |
| Invention example M17c | Invention example M17 | F | 1.0 | 80 | 0.8 | Henschel mixer *3 (100 rpm) | 25 | 27.1 | 17 | 7.30 | Satisfactory |
| Invention example M13e | Invention example M13 | C, D | 90 | 200 | 0.4 | V-shaped blender | 65 | 23.9 | 20 | 7.02 | Minute white dots |
| Invention example M18e | Invention example M18 | E | 0.05 | 5 | 0.5 | Redig mixer | 50 | 25.1 | 19 | 7.32 | Satisfactory |
| Invention example M15e | Invention example M15 | B | 5.0 | 250 | 1.5 | Rotation double conical | 40 | 25.8 | 17 | 7.21 | Minute white dots |
| Invention example M17e | Invention example M17 | F | 1.0 | 80 | 0.8 | Henschel mixer *4 (1000 rpm) | 5 | 27.5 | 19 | 7.31 | Satisfactory |
| Comparative example M13c | Comparative example M13 | C, D | 1.0 | 200 | 0.4 | V-shaped blender | 65 | 25.1 | 35 | 6.92 | White dots |
| Comparative example M18c | Comparative example M18 | E | 0.05 | 20 | 0.5 | Redig mixer | 50 | 25.4 | 34 | 7.28 | Scratched |
| Comparative example M15c | Comparative example M15 | B | 5 | 80 | 1.5 | Rotation double conical | 40 | 26.3 | 30 | 7.19 | White dots |
| Comparative example M17c | Comparative example M17 | F | 1.0 | 80 | 0.8 | Henschel mixer *3 (100 rpm) | 25 | 31.5 | 34 | 7.22 | Scratched |
| Comparative example M13d | Comparative example M13 | C, D | 90 | 200 | 0.4 | V-shaped blender | 65 | 24.4 | 37 | 6.90 | White dots |
| Comparative example M18d | Comparative example M18 | E | 0.05 | 5 | 0.5 | Redig mixer | 50 | 26.7 | 40 | 7.24 | Scratched |
| Comparative example M15d | Comparative example M15 | B | 5.0 | 250 | 1.5 | Rotation double conical | 40 | 26.1 | 21 | 7.21 | White dots |
| Comparative example M17d | Comparative example M17 | F | 1.0 | 80 | 0.8 | Henschel mixer *4 (1000 rpm) | 5 | 32.1 | 38 | 7.20 | Scratched |

*1 Adding amount: value as to total of 100 parts by weight of iron-based powder and powder additives proper

*2 Percentage of secondary particles: percentage of particles 10 to 200 μm in diameter as to the total free lubricant

*3 100 rpm: the velocity at the tip of the stirring blades is 60 m/min or lower.

*4 1000 rpm: the velocity at the tip of the stirring blades is higher than 60 m/min.

As can be understood from Table 10, Invention examples M7c through M18c and M18d, and M13e through M17e each exhibited excellent flowability, ejection pressure, and green density. However, in the event that the average particle size of the primary particles of the free lubricant exceeds 80 μm, the ejecting pressure at the time of forming the iron-based powder mixture increases somewhat (comparison between Invention example M13c and Invention example M13e). Also, in the event that the secondary particles of the free lubricant are smaller than 10 μm, the ejection pressure at the time of forming the iron-based powder mixture increases somewhat, and further the green density is also somewhat lower (comparison between Invention example M18c and Invention example M18e). On the other hand, in the event that the secondary particles of the free lubricant exceed 200 μm, there is no problem with compacting the iron-based mixed powder, but white dots due to agglomeration of the lubricant were observed in minute amounts on the surface of the green compact (comparison between Invention example M15c and Invention example M15e).

Also, in the event of mixing the free lubricant under high shearing conditions (equivalent to 1,000 rpm or higher with a Henschel mixer), the percentage by volume of the secondary particles within the predetermined particle size range in the free lubricant following mixing drops to below 20% by volume, and the flowability of the powder also deteriorates somewhat. Further, the ejecting pressure at the time of powder compaction also increases somewhat, and the green compact density also deteriorates somewhat (comparison between Invention example M17c and Invention example M17e).

This shows that even within the invention, a compact with particularly excellent ejection pressure, green density, and external appearance, can be obtained by mixing the free lubricant containing 20% by volume or more of aggregated secondary particles, with a second particle size of 10 to 200 μm that have been formed of primary particles with a particle size of 0.01 to 80 μm, into the iron-based powder at a percentage of 0.01 to 2.0% parts by mass, under low-shearing conditions.

Conversely, with Comparative examples M13c through M17c and M13d through M17d wherein the same free lubricant mixing processing was performed using powder additives to which organic binder have not been provided beforehand, the greater part of the powder additives is free, so the effects of the lubricant were not uniform. Consequently, the properties such as ejection pressure of the green compact and so forth were poorer than those of the corresponding Invention examples (M13c through M17c and M13e through M17e). Also, some of these Comparative examples exhibited scratches from ejection, and white dots owing to the lubricant.

FIFTH EXAMPLE

An iron-based mixed powder for powder metallurgy was made in the same way as with the third Example, except that the primary mixing lubricant and the secondary mixing lubricant shown in Table 7 were not used.

Next, the iron-based mixed powder described above was heated to a temperature lower than the melting point of the components of the organic binder on the surface of the powder additives, and a processing liquid wherein the lubricant particles shown in Table 11 have been dispersed in a dispersion medium (including emulsion) was sprayed thereupon following which the powder was subjected to a drying process at the temperatures shown in Table 11, thus preparing the various iron base mixture powders for powder metallurgy. The adhesion of the powder additive was measured for each mixed powder obtained. Subsequently after cooling, some of the mixed powders were mixed with the free lubricant subjected to aggregation under the conditions described in the fourth Example, thereby fabricating various types of iron-based mixed powders for powder metallurgy.

Table 11 also shows the results of checking the flowability, ejection pressure, and green compact density of the iron-based mixed powder thus obtained in Table 11.

TABLE 11

| | | Lubricant particles | | | | | | | | Binder + | | | |
|---|---|---|---|---|---|---|---|---|---|---|---|---|---|
| | Iron-based powder and powder additives | Type | Particle size (μm) | Adding amount *1 (Parts by weight) | Type of dispersion medium | Drying temperature (° C.) | Graphite adhesion (%) | Cu adhesion (%) | Free lubricant and mixing method | Lubricant*1 (total amount) (parts by weight) | Properties: Flowability (s/50 g) | Properties: Ejection pressure (MPa) | Properties: Green density (Mg/m$^3$) |
| Invention example M18g | Invention example M18b | A | 0.05 | 0.3 | Isopropanol | 80 | 92 | 75 | — | 0.39 | 25.1 | 16.3 | 7.32 |
| Invention example M13f | Invention example M13 | B | 4.0 | 0.4 | Water | 80 | 98 | — | — | 0.51 | 24.8 | 18.1 | 7.03 |
| Invention example M15f | Invention example M15 | D | 0.1 | 0.6 | Ethanol | 100 | 97 | 95*2 | — | 0.63 | 29.3 | 19.0 | 7.26 |
| Invention example M18f | Invention example M18 | G | 5.0 | 0.5 | Water | 100 | 92 | 89 | — | 0.59 | 30.0 | 18.3 | 7.31 |
| Invention example M18h | Invention example M18b | A | 0.1 | 0.3 | Water | 80 | 95 | 73 | — | 0.39 | 24.8 | 17.3 | 7.32 |
| Invention example M18i | | | | | | | | | Invention example M18d | 0.69 | 27.3 | 13.0 | 7.26 |
| Invention example M8h | Invention example M8 | E | 0.2 | 0.2 | Water | 80 | 93 | 89 | — | 0.74 | 24.9 | 19.4 | 7.26 |

TABLE 11-continued

| | Iron-based powder and powder additives | Lubricant particles Type | Par-ticle size (μm) | Adding amount *1 (Parts by weight) | Type of dispersion medium | Drying temp-erature (° C.) | Graph-ite adhe-sion (%) | Cu adhe-sion (%) | Free lubricant and mixing method | Binder + Lubri-cant*1 (total amount) (parts by weight) | Properties Flow-ability (s/50 g) | Ejection pressure (MPa) | Green density (Mg/m³) |
|---|---|---|---|---|---|---|---|---|---|---|---|---|---|
| Invention example M8i | | | | | | | | | Invention example M8c | 1.34 | 29.8 | 14.0 | 7.23 |
| Invention example M13j | Invention example M13 | B | 16 | 0.4 | Water | 80 | 95 | — | — | 0.51 | 25.1 | 18.9 | 7.02 |
| Invention example M15j | Invention example M15 | D | 23 | 0.6 | Ethanol | 100 | 98 | 94*2 | — | 0.63 | 30.0 | 20.1 | 7.25 |
| Invention example M18k | Invention example M18b | A | 20 | 0.3 | Water | 80 | 94 | 75 | — | 0.39 | 25.1 | 18.0 | 7.31 |
| Invention example M18m | | | | | | | | | Invention example M18d | 0.69 | 28.0 | 14.1 | 7.26 |
| Comparative example M15f | Comparative example M15 | D | 0.1 | 0.6 | Ethanol | 100 | 85 | 94*2 | — | 0.60 | 31.1 | 28.0 | 7.21 |
| Comparative example M18h | Comparative Example M18 | A | 0.1 | 0.3 | Water | 80 | 75 | 52 | — | 0.30 | 29.4 | 32.3 | 7.24 |
| Comparative example M18i | | | | | | | | | Invention example M18d | 0.60 | 32.0 | 29.5 | 7.20 |
| Comparative example M8h | Comparative example M8 | E | 0.2 | 0.2 | Water | 80 | 55 | 49 | — | 0.20 | 26.0 | 35.1 | 7.25 |
| Comparative example M8i | | | | | | | | | Invention example M8c | 0.80 | 32.3 | 30.3 | 7.19 |
| Comparative example M15n | Comparative example M15 | D | 0.1 | 0.9 | Ethanol | 100 | 93 | 94*2 | — | 0.90 | 29.8 | 25.0 | 7.20 |
| Comparative example M18o | Comparative example M18 | A | 0.1 | 0.6 | Water | 80 | 94 | 88 | — | 0.60 | 32.5 | 27.5 | 7.21 |
| Comparative example M18p | | | | | | | | | Invention example M18d | 0.90 | 35.0 | 25.9 | 7.16 |
| Comparative example M8o | Comparative example M8 | E | 0.2 | 1.1 | Water | 80 | 92 | 90 | — | 1.10 | 29.1 | 31.0 | 7.20 |
| Comparative example M8p | | | | | | | | | Invention example M8c | 1.70 | 34.0 | 26.7 | 7.15 |
| Comparative example M13j | Comparative example M13 | B | 16 | 0.4 | Water | 80 | 86 | — | — | 0.40 | 31.1 | Unformable | |
| Comparative example M15j | Comparative example M15 | D | 23 | 0.6 | Ethanol | 100 | 84 | 95*2 | — | 0.60 | 35.5 | Unformable | |
| Comparative example M18k | Comparative example M18 | A | 20 | 0.3 | Water | 80 | 73 | 45 | — | 0.30 | 31.4 | Unformable | |
| Comparative example M18m | | | | | | | | | Invention example M18d | 0.60 | 32.8 | 22.5 | 7.20 |

*1 Adding amount, total amount: value as to a total of 100 parts by weight of iron-based powder and powder additives proper
*2 Alloy or partial alloy in iron-based powder As can be clearly understood from Table 11, the iron-based powder coated using the processing liquid wherein lubricant particles are dispersed according to the invention has a uniform coating formed on the surface of the iron-based powder particles to which the powder additive particles have adhered, thereby improving the flowability thereof, and further improving the ejection pressure and green density. However, in the event of using a dispersion liquid wherein lubricants outside of the range of average particle size of 0.01 to 10 μm are dispersed, the uniformity of the coating deteriorates somewhat, so the lubricant particles agglomerate one with another somewhat, deteriorating the flowability of the iron-based mixed powder somewhat (comparison between Invention examples M13f, M15f, M18h, M18i, and Invention examples M13j, M15j, M18k, M18m, respectively).

Also, in the event that a uniform coating is formed by adding the free lubricant according to the aggregation method, following coating of the above lubricant, both the flowability and the compacting properties are improved (Invention examples M18i, M8i, and M18m). These advantages are particularly markedly visible in the event of processing with a dispersion liquid containing lubricant particles within the range of average particle size of 0.01 μm to 10 μm (Invention examples M18i and M8i).

Conversely, with the comparative examples wherein the same free lubricant mixing processing is performed using powder additives to which organic binder has not been provided beforehand, the lubricant listed in Table 11 alone is used to fix the powder additives, so the adhesion of the powder additives was poor, and accordingly, the effects of lubrication where not uniform. Consequently, the properties such as ejection pressure of the green compact and so forth were poorer as compared with the corresponding Examples of the invention denoted by the same symbols, and some were incapable of forming at all. Further, with the comparative example using water as a dispersion medium (particularly with M8h and M8i), rust was observed on the green compact.

Also, the Comparative examples M15n, M18o, M18p, M8o, and M8p are examples wherein the amount of lubricant is increased to achieve an adhesion of powder additives close to that of the Invention examples M15f, M18h, M18i, M8h, and M8i, respectively, but the sum of lubricant and binder required is 1.4 times or more (meaning that conversely, the sum of lubricant and binder required for the present invention is around 70% of what has been conventionally required), and accordingly, the green density deteriorated considerably.

Thus according to the invention configured and carried out as described above, there is little segregation of the components of the powder additives for powder metallurgy, so irregularities in dimensions of sintered material and irregularities in the mechanical strength thereof can be reduced.

Also, the lubricants can be uniformly dispersed throughout the iron-based mixed powder for powder metallurgy, so flowability of the mixed powder, and ejection pressure from the die improves.

Further, water can be used as a dispersion medium for coating the iron-based mixed powder for powder metallurgy with lubricants, thereby facilitating reduction in costs.

Moreover, the amount of binder and lubricant added can be reduced over conventional arrangements, thereby enabling an iron-based mixed powder for powder metallurgy to be provided with little segregation and high compaction capabilities.

What is claimed is:

1. A powder additive for mixture with an iron-based powder in powder metallurgy comprising:

bodies of powder additive particles; and organic binder provided on surfaces of the particles.

2. A powder additive according to claim 1, wherein said powder additive is an alloying powder or a machinability improving powder.

3. A powder additive according to claim 1, wherein said organic binder is thermoplastic resin and/or waxes.

4. An iron-based powder mixture comprising a powder additive comprising bodies of powder additive particles; an organic binder provided on surfaces of the particles bonded to surfaces of iron-based powder by said organic binder, wherein surfaces of said iron-based powder to which said powder additive has been bonded is substantially covered with a lubricant.

5. The iron-based powder mixture according to claim 4, wherein said lubricant comprises particles with an average particle size of about 0.01 to about 10 μm.

6. The iron-based powder mixture according to claim 5, further comprising a free lubricant.

7. The iron-based powder mixture according to claim 4, further comprising a free lubricant.

8. The iron-based powder mixture according to claim 7, wherein said free lubricant includes secondary particles aggregated by agglomerating primary particles.

9. The iron-based powder mixture according to claim 8, wherein average particle size of said primary particles of said free lubricant is about 0.01 to about 80 μm, and wherein said free lubricant contains at least about 20% by volume of secondary particles with an average particle size of about 10 to about 200 μm based on the amount of said free lubricant.

10. The iron-based powder mixture according to claim 7, wherein said free lubricant is added in a range of about 0.01 to about 2.0 parts by weight to 100 parts by weight of a total of said primary raw material powder and the bodies of powder additive particles.

11. The powder additive according to claim 1, wherein the organic binder covers the surfaces of the bodies of powder additive particles.

12. The powder additive according to claim 1, wherein the organic binder is interspersed on the surfaces of the bodies of powder additive particles.

13. The powder additive according to claim 12, wherein the organic binder covers at least 1% of the surfaces of the particles.

14. The powder additive according to claim 1, wherein the organic binder is present in an amount of 0.5–50 parts by weight based on 100 parts by weight of the particles.

15. The powder additive according to claim 1, wherein the particles have an average particle size of about 0.1 to about 50 μm.

16. The powder additive according to claim 1, wherein said organic binder either coats said bodies of powder additive particles or disperses substantially over the surface of the bodies of powder additive particles.

17. An iron-based powder mixture for powder metallurgy comprising said powder additive according to claim 16, bonded to surfaces of iron-based powder by said organic binder.

18. The iron-based powder mixture according to claim 17, wherein said organic binder is dispersed substantially over the surface of the bodies of the particle.

19. The iron-based powder mixture according to claim 17, wherein there is essentially no adhesion of said organic binder on the iron-based powder except for the point of adhesion with the additives.

20. The iron-based powder mixture according to any one of claims 17 to 19, wherein surfaces of said iron-based powder to which said powder additive has been bonded are substantially covered with a lubricant.

21. The iron-based powder mixture according to claim 20, wherein said lubricant comprises particles with an average particle size of about 0.01 to about 10 μm.

22. The iron-based powder mixture according to any one of claims 17 to 19, further comprising a free lubricant.

23. The iron-based powder mixture according to claim 20, further comprising a free lubricant.

24. The iron-based powder mixture according to claim 22, wherein said free lubricant includes secondary particles aggregated by agglomerating primary particles.

25. The iron-based powder mixture according to claim 24, wherein average particle size of said primary particles of said free lubricant is about 0.01 to about 80 $\mu$m, and wherein said free lubricant contains at least about 20% by volume of secondary particles with an average particle size of about 10 to about 200 $\mu$m based on the amount of said free lubricant.

26. The iron-based powder mixture according to claim 22, wherein said free lubricant is added in a range of about 0.01 to about 2.0 parts by weight to 100 parts by weight of a total of said primary raw material powder and the bodies of powder additive particles.

* * * * *

UNITED STATES PATENT AND TRADEMARK OFFICE

CERTIFICATE OF CORRECTION

PATENT NO. : 6,860,918 B2
DATED : March 1, 2005
INVENTOR(S) : Ozaki et al.

It is certified that error appears in the above-identified patent and that said Letters Patent is hereby corrected as shown below:

Column 25,
Table 7, Example M15, Type *1 (first occurrence), please change "c" to -- e --;
Example M15, Invention, Type *1 (second occurrence), please change "c" to -- e --; and
Example M16, Invention, Type *1 (second occurrence), please change "c" to -- e --.

Signed and Sealed this

Sixth Day of September, 2005

JON W. DUDAS
*Director of the United States Patent and Trademark Office*